US005748167A

United States Patent [19]

Watanabe et al.

[11] Patent Number: 5,748,167

[45] Date of Patent: May 5, 1998

[54] DISPLAY DEVICE FOR SAMPLING INPUT IMAGE SIGNALS

[75] Inventors: Gaku Watanabe, Tokyo; Yasuyuki Yamazaki, Matsudo, both of Japan

[73] Assignee: Canon Kabushiki Kaisha, Tokyo, Japan

[21] Appl. No.: 635,457

[22] Filed: Apr. 22, 1996

[30] Foreign Application Priority Data

| | | | |
|---|---|---|---|
| Apr. 21, 1995 | [JP] | Japan | 7-118939 |
| May 1, 1995 | [JP] | Japan | 7-128773 |
| Jul. 7, 1995 | [JP] | Japan | 7-194053 |
| Jul. 14, 1995 | [JP] | Japan | 7-200214 |

[51] Int. Cl.[6] ..... G09G 3/36

[52] U.S. Cl. ..... 345/98; 345/99

[58] Field of Search ..... 345/98, 88, 22, 345/99, 100, 87; 359/51, 68; 315/366

[56] References Cited

U.S. PATENT DOCUMENTS

| | | | |
|---|---|---|---|
| 4,724,433 | 2/1988 | Inoue et al. | 340/805 |
| 4,825,203 | 4/1989 | Takeda et al. | 345/100 |
| 4,944,578 | 7/1990 | Denison | 345/88 |
| 5,168,270 | 12/1992 | Masumori et al. | 345/100 |
| 5,418,547 | 5/1995 | Mizukata et al. | 345/98 |
| 5,469,278 | 11/1995 | Takahara et al. | 359/51 |
| 5,523,772 | 6/1996 | Lee | 345/100 |
| 5,525,873 | 6/1996 | Lambert et al. | 315/366 |
| 5,552,801 | 9/1996 | Furuhashi et al. | 345/100 |
| 5,579,027 | 11/1996 | Sakurai et al. | 345/100 |
| 5,604,511 | 2/1997 | Ohi | 345/98 |
| 5,646,644 | 7/1997 | Furuhashi et al. | 345/100 |

*Primary Examiner*—Mark R. Powell
*Assistant Examiner*—John Suraci
*Attorney, Agent, or Firm*—Fitzpatrick, Cella, Harper & Scinto

[57] ABSTRACT

A display device performs sampling of an input image signal for displaying by a dot matrix display element, and includes a selection unit for, in consonance with types of information to be displayed, selecting either to supply a predetermined pixel group with a signal that is obtained by sampling at a first timing, or to supply the predetermined pixel group with a signal that is obtained by sampling at a second, different timing. In addition, the display device, which performs sampling of input image signals and displays the resultant signal by using a dot matrix display element, includes a detection circuit for detecting character information that is included in the input image signal, and a unit for altering a method for processing the input image signal in consonance with an output of the detection circuit.

56 Claims, 25 Drawing Sheets

DISPLAY DEVICE FOR SAMPLING INPUT IMAGE SIGNALS

BACKGROUND OF THE INVENTION

1. Field of the Invention

The present invention relates to a display device, such as a liquid display device, a plasma display, an electrochromic device, a field emission display, or a digital micro mirror device, that has dot matrix elements in which display pixels are arranged during a predetermined cycle.

2. Related Background Art

FIG. 29 is a diagram illustrating an example of an image device in which display pixels, for which luminance can be controlled by an input control signal, are arranged as multiple matrixes, and in which the luminance levels (display states) of display pixels correspond to input image signals. In FIG. 29, R1, G1 and B1 denote arbitrary portions of display pixels in a display device; and SR, SG and SB are image signals that are input to a liquid crystal display device and are supplied to red, green and blue display pixels. The red, green and blue pixels are hereinafter called dots. Although a set of three of the pixels may sometimes be called a pixel, in this case, an individual color pixel is regarded as one pixel.

Conventionally, when, by using an image signal, signal values r1, g1 and b1 are respectively acquired for display pixels R1, G1 and B1 by sampling during a cycle 3T, and a display is performed with these obtained signal values, folded distortion of luminance signals is noticeable on a display screen. In order to prevent the occurrence of such folded distortion of luminance signals, a method is employed by which an image signal is used to perform sampling of the individual color pixels during a cycle T. By sampling during the cycle T, signal value r1 is acquired for display pixel R1 at time t1, signal value g2 is acquired for display pixel G1 at time t2, and signal value b3 is acquired for display pixel B1 at time t3. In other words, to perform sampling this method matches the horizontal position of a display pixel with the horizontal position of an image.

With this display method, the influence of the folded distortion of a luminance signal is reduced, but depending on the degree of change that is carried by an input image signal, color moiré appears on a display screen during a cycle that is shorter than the cycle T. To remove this, a method is employed by which low-pass filtering of an input image signal is performed.

However, according to the above described method, when an image signal is passed through a low-pass filter in order to remove color moire, a signal, which is in the vicinity of a sampling cycle and which is included in the original image signal, is also removed, so that the resolution of an image is reduced.

FIG. 30 is a block diagram illustrating a liquid crystal display device. In FIG. 30, reference number 401 denotes an input terminal of an image signal; 402, a signal processing circuit; 403, a synchronizing separation circuit; 404, a controller; 405, an X-driver; 406, a Y-driver; and 407, an XY matrix liquid crystal display (hereinafter referred to as an LCD). The signal processing circuit 402 performs a predetermined process, such as γ compensation or inversion, on an image signal that is input at the input terminal 401 in order to display the image signal. The processed signal is transmitted to the X-driver 405, and also to the synchronizing separation circuit 403, which separates a synchronization signal from the received signal. The separated synchronization signal is transmitted to the controller 404. In response to the signal, the controller 404 supplies, to the X-driver 405 and the Y-driver 406, a predetermined drive pulse, for driving the LCD 407, that is synchronized with an image signal. The LCD 407 is driven by an image signal and a drive pulse that are supplied by the X-driver 405, and a drive pulse that is supplied by the Y-driver 406, and displays the received image signal.

FIG. 31 is a diagram illustrating the LCD 407 in FIG. 30. In FIG. 31, reference number 461 is used to denote individual switching devices, which are FETs; 462, individual liquid crystal cells; 463, individual support capacitors for supporting signal electrical charges; 464R, 464G and 464B, individual input terminals for primary color signals (R, G and B) that are supplied by the X-driver 405; 465R, 465G and 465B, individual switching devices, which are FETs; 466, a common electrode for the liquid crystal cells 462; 467R, 467G and 467B, individual terminals at which a drive pulse that is supplied by the X-driver 405 is input; and 468, individual input terminals at which a drive pulse that is supplied by the Y-driver 406 is input.

In the LCD shown in FIG. 31, the arrangement by color of the individual pixels corresponds to the R, G and B striped color filter arrangement that is shown in FIG. 32.

FIG. 33A is a diagram illustrating the arrangement of the X-driver 405 in FIG. 30, and FIG. 33B is a diagram illustrating the arrangement of the Y-driver 406. As is shown in FIGS. 33A and 33B, the X-driver 405 and the Y-driver 406 are shift registers. In FIGS. 33A and 33B, reference number 421 denotes a terminal at which a start pulse for the shift register is input; 422, a terminal at which a drive pulse for the shift register is input; 423, D flip-flops; 424, terminals from which LCD drive pulses that are transmitted by the X-driver 405 are output; 431, a terminal at which a drive pulse for the shift register is input; 433, D flip-flops; and 434, terminals from which LCD drive pulses that are transmitted by the Y-driver 406 are output.

The operation of a conventional LCD will now be described while referring to FIGS. 31, 33A and 33B. When a start pulse is received at the input terminal 421 at the beginning of a horizontal scan period, and when a clock of m/3 times (m is the number of pixels in the horizontal direction for a liquid crystal display device) a horizontal frequency is received at the input terminal 422, the shift register for m/3 stages in FIG. 33A is driven by the input driven pulse, and the output pulse of the shift register is transmitted to the output terminals 424. At this time, one of the output terminals 424 is commonly connected to three input terminals 467R, 467G and 467B. When the same drive pulse that is output by the X-driver 405 is simultaneously supplied to the gates of the three switching devices, 465R, 465G and 465B, and all the switches are thus turned on at the same time, sampling is performed for image signals that are simultaneously input at the input terminals 464R, 464G and 464B, and the resultant signals are supplied to vertical signal lines. One end of each of the switching devices 461 is connected to each of the vertical lines, and the other end is connected to the liquid crystal cell 462 and the capacitor 463. Therefore, signal writing is simultaneously performed for each three vertical scan lines, and as a drive pulse is sequentially output from the shift register of the X-driver 405, horizonal scanning is also performed. Furthermore, when a start pulse is input at the input terminal 431 at the beginning of a vertical scan period, and a horizonal frequency clock is input at the input terminal 432, the shift register having n stages (n is the number of pixels in the vertical direction of a liquid crystal display device) in FIG.

33B is driven by the drive pulse, and the output pulse of the shift register is output to the output terminals 434. Each of the output terminals 434 is connected to the input terminal 468. When a drive pulse that is output by the Y-driver 406 is supplied to the gate of the switching device 461 across a predetermined horizontal gate line, and each switch is turned on, the liquid crystal cell 462 and the capacitor 463 hold electric charges that correspond to potential differences between signals that are supplied to the input terminals 464R, 464G and 464B, and a voltage that is applied to the common electrode 466. At this time, a predetermined voltage is provided for the common electrode 466. The above process is repeated and an image for one screen can be displayed on the LCD shown in FIG. 31.

So long as the number of pixels on the LCD is sufficient, a satisfactory resolution can be acquired with the above described conventional arrangement; however, if the number of pixels is increased for a small LCD having a diagonal measurement of 10 cm or less, the dimension per pixel is reduced more than it is for a large LCD having a diagonal measurement of 20 cm or more, the rate of opening is reduced, and a satisfactory brightness can not be obtained. For this reason, the number of pixels for an LCD can not be too greatly increased. Therefore, in order to acquire a resolution having a satisfactory appearance while using an LCD that has a small number of pixels, an X-driver shown in FIG. 34 is used instead of the X-driver 405 in FIG. 33A. In FIG. 34, the same reference numbers as are used in FIGS. 33A and 33B are used to denote corresponding or identical components. The X-driver in FIG. 34 is a stage shift register. When a start pulse is input at an input terminal 421 at the beginning of the horizonal scan period, and a clock of m times a horizontal frequency is input at an input terminal 422, the m-stage shift register in FIG. 33A is driven by the drive pulse, and an output pulse from the shift register is output to output terminals 424. One of the output terminals 424 is connected to three input terminals, 467R, 467G and 467B. The drive pulse output by the X-driver is sequentially supplied to the gates of switching devices 465R, 465G and 465B, and switches are turned on in order. Then, at different timings, sampling of image signals that are input at input terminals 464R, 464G and 464B is performed, and following the sampling, the signals are supplied to vertical signal lines. The vertical scanning operation is performed in the same manner as is described in the previous conventional example, and an image for one screen is displayed on the LCD in FIG. 31. By increasing the sampling frequency for horizontal image signals, resolution is enhanced for an LCD having a small number of pixels.

However, in the prior art in FIGS. 33A and 33B, since sampling is performed at the three pixels R, G and B by using the same phase, a satisfactory resolution can not be obtained if an LCD has an insufficient number of pixels. In addition, if sampling to remove the above shortcoming is performed at the three pixels R, G and B at different phases, as is described in FIG. 34, folded distortion (color moiré) that is caused by sampling is noticeable when fine images, especially characters, are displayed.

SUMMARY OF THE INVENTION

It is one object of the present invention to provide a display device that can perform the high quality display of character information and non-character information even though an inexpensive display element that has a comparatively small number of pixels is employed.

It is another object of the present invention to provide a display device, which performs sampling of input image signals for displaying by a dot matrix display element, that comprises selection means for, in consonance with types of information to be displayed, selecting either to supply a predetermined pixel group a signal that is obtained by sampling at a first timing, or to supply the predetermined pixel group a signal that is obtained by sampling at a second, different timing.

It is an additional object of the present invention to provide a display device, which performs sampling of input image signals for displaying by a dot matrix display element, that comprises: a detection circuit for detecting character information that is included in the input image signal; and means for altering a method for processing the input image signal in consonance with an output of the detection circuit.

To achieve the above objects according to the present invention, a display device, which performs sampling of an input image signal during a predetermined cycle and acquires signal values for color signals, and which, based on these values, displays pixels for three colors, red, green and blue, that are arranged in a matrix form, comprises: comparison means, for comparing a difference between two signal values, which are selected from among the signal values obtained by sampling, with a predetermined threshold value; and means for, in consonance with an output of the comparison means, selectively switching a signal value that is to be provided for a display pixel.

The input image signal is either one or both of a pair of signals for controlling display pixels for red, green and blue, and a luminance signal.

When sequential sampling of a luminance signal is performed at times t1, t2 and t3 ($t1<t2<t3$) and three signal values yn1, yn2 and yn3 are acquired, and when the three signal values correspond respectively to luminances for red, green and blue pixels that are sequentially arranged, the comparison means compares a difference between yn1 and yn2 with a predetermined threshold value, and compares a difference between yn2 and yn3 with the predetermined value.

When sequential sampling of a luminance signal for a green pixel is performed at times t1, t2 and t3 ($t1<t2<t3$) and three signal values gn1, gn2 and gn3 are acquired, and when, from among the three signal values, gn2 corresponds to a signal value that is provided for a green pixel from among red, green and blue pixels that are sequentially arranged, the comparison means compares a difference between gn1 and gn2 with a predetermined threshold value, and compares a difference between gn2 and gn3 with the predetermined value.

As means for selecting signal values from among signal values rn1, rn2 and rn3, signal values gn1, gn2 and gn3, and signal values bn1, bn2 and bn3, which are acquired by sequentially sampling luminance signals for red, green and blue pixels, respectively, at times t1, t2 and t3 ($t1<t2<t3$), and for providing a continuous red, green and blue pixel arrangement, the comparison means includes means for selecting either rn1 or gn2 and for providing the selected signal value for a red pixel; means for providing signal value gn for a green pixel; and means for selecting either bn3 or gn2 and providing the selected signal value for a blue pixel.

A display device, such as a liquid crystal display device, in which display pixels for red, green and blue (hereinafter referred to as R, G and B) are arranged in a matrix form, can prevent color moiré when an image is to be displayed as an image signal is input, and can also effectively utilize for a display information concerning the input image signal.

Further, to achieve the above objects, according to the present invention, a display device, which performs sampling of an input image signal during a predetermined cycle and employs the sampled signals to display pixels for three colors, red, green and blue that are arranged in a matrix form, comprises: sampling means for sequentially performing sampling, at times t1, t2 and t3 (t1<t2<t3), of signals for controlling red, green and blue display pixels in an input image signal, and for respectively acquiring signal values rn1, rn2 and rn3, and gn1, gn2 and gn3, and bn1, bn2 and bn3; selection means for selecting three signal values from among the thus acquired signal values and for comparing a difference between two signal values, which are selected from among the signal values obtained by sampling, with a predetermined value, and selecting and outputting three signal values in consonance with a result of the comparison; and means for displaying corresponding red, green and blue pixels in consonance with the signal values that are selected.

Further, when the selection means compares a difference |rn1−rn2| between the signal values rn1 and rn2 with threshold value Th, and as a result |rn1−rn2|>Th is established, or when the selection means compares a difference |rn2−rn3| between the signal values rn2 and rn3 with the threshold value Th, and as a result |rn2−rn3|>Th is established, the selection means selectively switches a signal value.

In addition, when the selection means compares a difference |gn1−gn2| between the signal values gn1 and gn2 with the threshold value Th, and as a result |gn1−gn2|>Th is established, or when the selection means compares a difference |gn2−gn3| between the signal values gn2 and gn3 with the threshold value Th, and as a result |gn2−gn3|>Th is established, the selection means selectively switches a signal value.

Furthermore, when the selection means compares a difference |bn1−bn2| between the signal values bn1 and bn2 with the threshold value Th, and as a result |bn1−bn2|>Th is established, or when the selection means compares a difference |bn2−bn3| between the signal values bn2 and bn3 with the threshold value Th, and as a result |bn2−bn3|>Th is established, the selection means selectively switches a signal value.

When the selection means compares a difference |rn1−gn2| between the signal values rn1 and gn2 with the threshold value Th, and as a result |rn1−gn2|>Th is established, or when the selection means compares a difference |gn2−bn3| between the signal values gn2 and bn3 with the threshold value Th, and as a result |gn2−bn3|>Th is established, the selection means selectively switches a signal value.

In consonance with the result of a comparison, the selection means changes the signal rn1, which is to be provided for the red pixel, and the signal value bn3, which is to be provided for the blue pixel, to the signal value gn1, gn2 or gn3.

The sampling means performs sampling for red, green and blue control signals at the times t1, t2 and t3 in order for the individual colors, and as a result, acquires further signal values Frn1, Frn2 and Frn3 Fgn1, Fgn2 and Fgn3, and Fbn1, Fbn2 and Fbn3. In consonance with the result of comparison, the selection means selects Frn1, Fgn2 and Fbn3 from among the signal values.

In addition, to achieve the above objects, according to the present invention, a display device, which displays red, green and blue pixels in consonance with corresponding red, green and blue signal values that are acquired by sampling red, green and blue signals that are included in an input image signal during a predetermined cycle, comprises: detection means for detecting a change value |A−B| between continuous signal values A and B that are acquired by sampling; first comparison means for comparing the signal value A with predetermined value L0; second comparison means for comparing the change value |A−B| with predetermined value D0; and replacement means for, in consonance with results of comparisons by the first and second comparison means, replacing a signal value, which is to be provided for a pixel for a specific color, with a signal value for another color.

When a result of a comparison by the first comparison means is A<L0, and a result of a comparison by the second comparison means is |A−B|>D0, the replacement means performs replacement of a signal value.

A display device, which displays red, green and blue pixels in consonance with corresponding red, green and blue signal values that are acquired by sampling red, green and blue signals that are included in an input image signal during a predetermined cycle, comprises: detection means for detecting a change value |A−B| between continuous signal values A and B that are acquired by sampling; means for outputting a predetermined comparison value in consonance with the signal value A; means for comparing the change value |A−B| with the comparison value; and means for, in consonance with results of comparisons by the first and the second comparison means, replacing a signal value, which is to be provided for a pixel for a specific color, with a signal value for another color.

A display device, which acquires red, green and blue signal values by sampling, during a predetermined cycle, for red, green and blue signals that are included in an input image signal, and which sequentially allocates the signal values for pixels of corresponding colors at each timing that is consonant with the cycle so as to display the pixels for individual colors that are arranged in a matrix form, comprises:

detection means for, in consonance with sequential signal values and a change value for at least one color that are acquired by sampling, determining that color moiré is noticeable; and means, when it is determined that the color moiré is noticeable, for allocating a signal value for a specific color to a pixel for a different color, instead of a signal value for the pixel for the different color.

With this arrangement, when the result of the comparison by the first comparison means is A<L0, and the result of the comparison by the second comparison means is |A−B|>D0, the luminance is low in a pixel area that corresponds to the signal value and there is a change in the luminance, and as a result color moiré tends to occur. In such a case, if a signal value for which there is a greater change in the luminance is employed to replace a signal value for another color, the appearance of color moiré in the above pixel area is prevented. On the other hand, when the luminance is high (A>L0), the replacement of a signal value is not performed, the deterioration of a resolution is prevented, and information carried by an input image signal is displayed more effectively. In a case where the change value |A−B| is compared with a predetermined comparison value that is consonant with signal value A to determine whether color moiré will tend to appear, a value that is proportional to the signal value A can be employed as the predetermined comparison value, and thus the determination can be made more accurately.

Further, while color moiré that occurs due to folded distortion through sampling is reduced, information carried by an input image signal is effectively displayed.

Since means for detecting a change pattern in the amplitude of an input image signal determines in which area color moiré in which particularly tends to appear, and selectively switches a signal value that is to be provided for a display pixel, information carried by an input image signal can be displayed more effectively.

In addition, to achieve the above objects, according to the present invention, provided is a liquid crystal display device, which comprises:

an XY matrix liquid crystal display, sampling means for sampling an input image signal at a predetermined timing and supplying the resultant signal to the liquid crystal display, and synthesizing means for adding character information to the input image signal, or character region discrimination means for identifying, from the input image signal, a region in which the character information is included; and wherein, for a region in which character information is not displayed, the sampling means supplies image signals with different phases that spatially match in a phase display positions of all pixels on the liquid crystal display, and wherein, for a region of the liquid crystal display in which character information is displayed, the sampling means supplies an image signal of the same phase, which spatially matches a display position of a specified pixel in a pair of given pixels that are adjacent and that each consist of one dot of the liquid crystal display, to each pair of the given pixels.

For a region in which character information is not displayed, the sampling means performs sampling at different timings at which phases spatially match display positions of the pixels on the liquid crystal display, and acquires image signals that are to be supplied to the pixels. For a region of the liquid crystal display in which character information is displayed, the sampling means performs sampling at the same timing at which a phase spatially matches a display position of the specified pixel of the given pixels on the liquid crystal display, and acquires an image signal that is to be supplied to the given pixels.

Further provided is delay means for delaying the image signal a predetermined time. The sampling means performs sampling at different timings, at which phases spatially match the display positions of the pixels on the liquid crystal display, to acquire signals that are to be supplied to the pixels. For a region in which character information is displayed, the delay means supplies the image signal to the sampling means after a delay so that the sampling means performs sampling of a signal, which is to be supplied to the given pixels, at the same timing at which a phase spatially matches the display position of the specified pixel of the given pixels. For a region in which character information is not displayed, the delay means supplies the image signal to the sampling without any delay.

Provided in addition is delay means for delaying the image signal a predetermined time. The sampling means performs sampling at the same timing at which a phase spatially matches the display position of the specified pixel of the given pixels, to acquire signals that are to be supplied to the given pixels. For a region in which character information is not displayed, the delay means supplies the image signal after a delay to the sampling means so that the sampling means performs sampling of a signal, which is to be supplied to the given pixels, at different timings at which phases spatially match the display positions of the given adjacent pixels. For a region in which character information is displayed, the delay means supplies the image signal to the sampling means without any delay.

According to the present invention, for a region in which character information is not displayed, image signals at different phases that spatially match the display positions of the pixels in a liquid crystal display are supplied to the individual pixels. For a region in which character information is displayed, an image signal of the same phase, which spatially matches the display position of a specified pixel of a plurality of pixels that form one dot of a liquid crystal display, is supplied to each of those pixels. Therefore, folded distortion can be prevented from occurring when character information is to be displayed.

When the delay means is provided, a conventional X-driver is applied to provide a liquid crystal display device that performs the same functions as are described above.

According to the present invention, provided is a display device, which comprises:

a display of dot matrix type, sampling means for performing sampling of an input signal at a predetermined timing and for supplying a resultant signal to the display, signal production means for producing a luminance signal and a color signal from an input image signal, signal level detection means for detecting signal levels of the luminance signal and the color signal, and character region discrimination means for employing a result of a detection by the signal level detection means to identify a region in an input image where character information is included, so that the input image that includes the character information is displayed on the display, wherein the character region discrimination means determines that a display image is the region in which character information is included when the signal level of the luminance signal that is detected by the signal level detection means is higher than a predetermined value; and the signal level of the color signal is lower than a predetermined value, and wherein, for a region in which character information is not displayed, the sampling means performs sampling at different timings, at which phases spatially match display positions of the pixels on the display, and acquires image signals that are to be supplied to the pixels, and, for a region in which character information is displayed, the sampling means performs sampling, at the same timing at which a phase spatially matches a display position of a specified pixel of three specific pixels on the display, and acquires an image signal that is to be supplied to the three specific pixels, so that folded distortion is prevented when character information is added to an input image and is displayed on the display.

According to the present invention, provided is a display device, which comprises:

a display of dot matrix type, sampling means for performing sampling of an input signal at a predetermined timing and for supplying a resultant signal to the display, signal production means for producing a luminance signal and a color signal from an input image signal, signal level change detection means for detecting a degree of change in signal levels of the luminance signal and the color signal, and character region discrimination means for employing a result of a detection by the signal level detection means to identify a region in an input image where character information is included, so that the input image that includes the character information is displayed on the display, wherein the character region discrimination means determines that a display image is the region in which character information is included when a degree of change in the signal level of the luminance signal, which is detected by the signal level detection means, is higher than a predetermined value and a degree of change in the signal level of the color signal is lower than a predetermined value; and wherein, for a region of the display in which character information is not displayed, the sampling means performs sampling at different timings at which phases spatially match display positions of pixels on the display and acquires image signals that are to be supplied to the pixels, and, for a region in which character information is displayed, the sampling means performs sampling at the same timing at which a phase spatially matches a display position of a specified pixel of three specified pixels on the display and acquires an image signal that is to be supplied to the three specified pixels, so that folded distortion is prevented when character information is added to an input image and is displayed on the display.

According to the present invention, provided is a display device, which comprises:

a display of dot matrix type, sampling means for performing sampling of an input signal at a predetermined timing and for supplying a resultant signal to the display, delay means for delaying an image signal a predetermined time;

signal production means for producing a luminance signal and a color signal from an input image signal, signal level detection means for detecting signal levels of the luminance signal and the color signal, and character region discrimination means for employing a result of a detection by the signal level detection means to identify a region in an input image where character information is included, so that the input image that includes the character information is displayed on the display, wherein the character region discrimination means determines that a display image is the region in which character information is included when the signal level of the luminance signal that is detected by the signal level detection means is higher than a predetermined value and the signal level of the color signal is lower than a predetermined value; and wherein, for a region in which character information is not displayed, a signal that is delayed by the delay means for the predetermined time is supplied to the sampling means and the sampling means performs sampling of the signal at the same timing at which a phase spatially matches a display position of a specified pixel of three pixels, and, for a region in which character information is displayed, a signal is supplied to the sampling means without any delay by the delay means, and the sampling means performs sampling at the same timing at which a phase spatially matches the display position of the specified pixel of the three specific pixels, so that a conventional X-driver is applied to prevent folded distortion when character information is added to an input image and is displayed on the display.

According to the present invention, provided is a display device, which comprises:

a display of dot matrix type, sampling means for performing sampling of an input signal at a predetermined timing and for supplying a resultant signal to the display, delay means for delaying an image signal a predetermined time;

signal production means for producing a luminance signal and a color signal from an input image signal, signal level detection means for detecting signal levels of the luminance signal and the color signal, and character region discrimination means for employing a result of a detection by the signal level detection means to identify a region in an input image where character information is included, so that the input image that includes the character information is displayed on the display, wherein the character region discrimination means determines that a display image is the region in which character information is included when the signal level of the luminance signal, which is detected by the signal level detection means, is higher than a predetermined value and the signal level of the color signal is lower than a predetermined value; and wherein, for a region in which character information is not displayed, a signal is supplied to the sampling means without any delay by the delay means and the sampling means performs sampling at different timings at which phases spatially match display positions of individual pixels, and, for a region in which character information is displayed, a signal that is delayed by the delay means for the predetermined time is supplied to the sampling means and the sampling means performs sampling of the signal at different timings at which phases spatially match display positions of the individual pixels, so that a conventional X-driver is applied to prevent folded distortion when character information is added to an input image and is displayed on the display.

DETAILED DESCRIPTION OF THE PREFERRED EMBODIMENTS

The preferred embodiments of the present invention will now be described. The basic structure will be described before specific arrangements are explained in detail while referring FIGS. 1 through 28.

Figure 35:
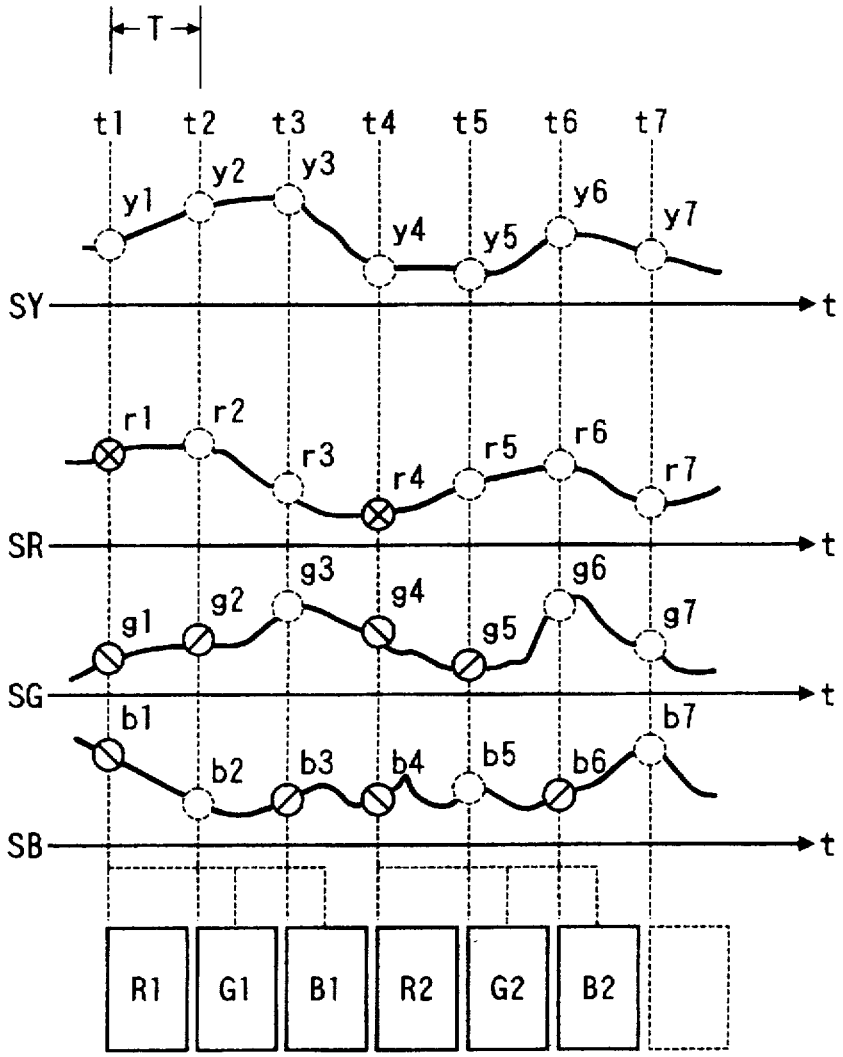
FIG. 35 is a specific timing chart for explaining the relationship between a sampling timing for input image signals and for display pixels for the display device of the present invention.

FIG. 35 is a timing chart for sampling that is performed by a display device for the present invention.

According to the present invention, in a mode in which is displayed character information, such as alphabets, Greek letters, Roman numerals, Arabic numerals, the Japanese syllabary, or Chinese characters, color signal r1 at phase t1 is supplied to red pixel R1, color signal g1 is supplied to green pixel G1, and color signal b1 is supplied to pixel B1. Similarly, color signals r4, g4 and b4 at phase t4 are respectively supplied to color pixels R2, G2 and B2.

In another mode for displaying non-character information, such as for landscape scenes and portraits that are recorded by a video camera, signal r1 at phase t1 is supplied to pixel R1, signal g2 at phase t2 is supplied to pixel G1, and signal b3 at phase t3 is supplied to pixel B1.

Similarly, at phases t4, t5 and t6, signals r4, g5 and b6 are respectively supplied to pixels R2, G2 and B2.

Color signals may be supplied to corresponding pixels without any change, or may be amplified and modified into a signal having a different waveform and be supplied to pixels. This is determined as needed by the characteristic of a display element and the structure of an XY driver.

Figure 36:
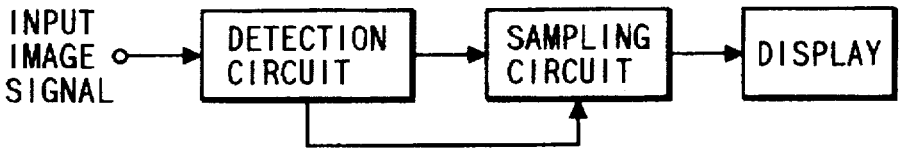
FIG. 36 is a block diagram illustrating a control system for the display device of the present invention.

FIG. 36 is a block diagram illustrating the structure in the display device of the present invention for detecting character information and switching the two above described modes in consonance with the result of a detection.

A detection circuit determines whether or not character information is present, and in consonance with the result of a determination, a method is decided on for distributing color signals that are obtained by sampling to pixels.

The time at which a mode is switched may be after one frame has been completed, but preferably is after one horizontal scan period has been completed.

In this manner, information for an image wherein characters are written to a landscape image can be appropriately displayed, and such a display device can serve as a multimedia device.

[First Embodiment]

Figure 1:
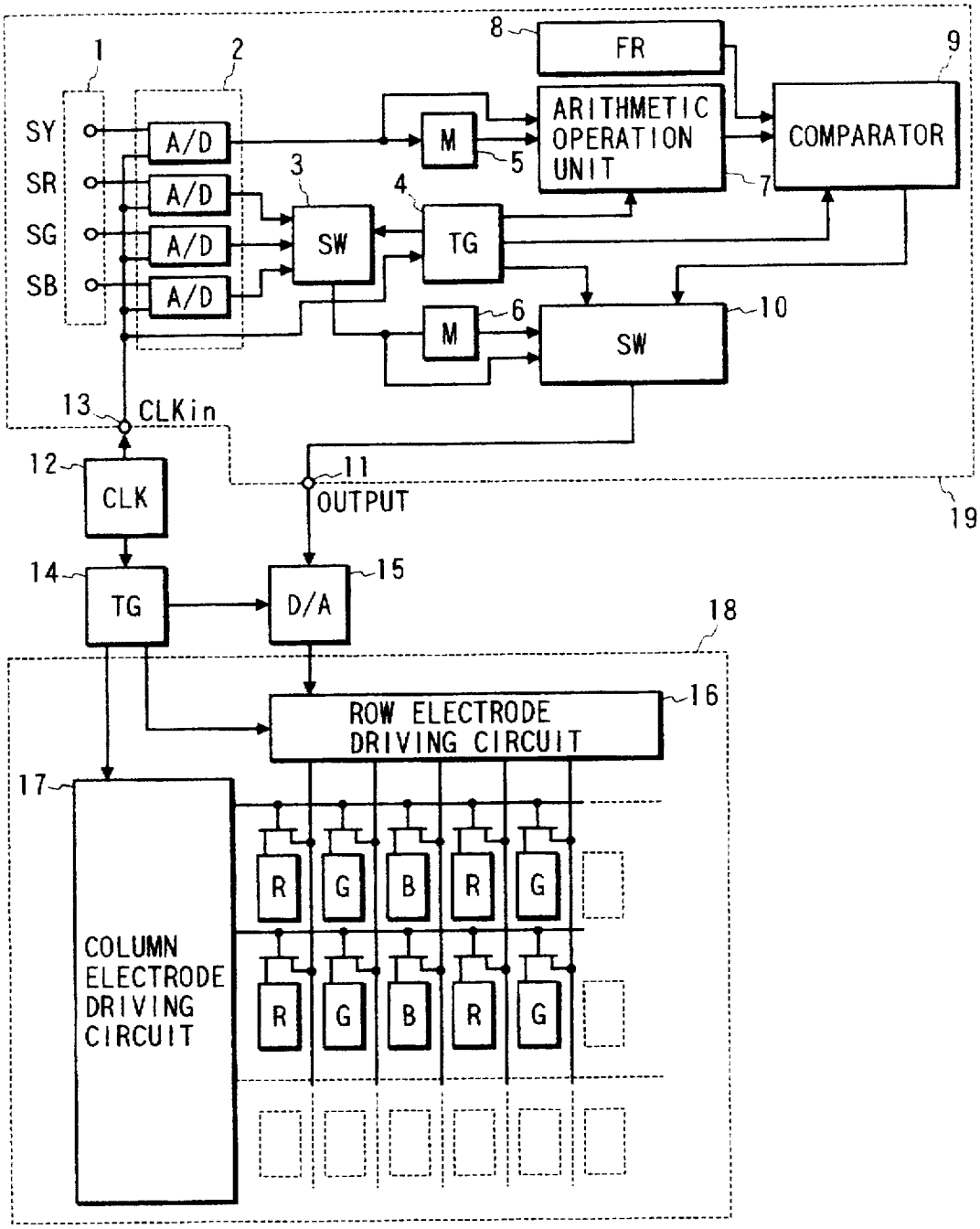
FIG. 1 is a block diagram illustrating a display device according to a first embodiment of the present invention.

FIG. 1 is a block diagram illustrating a TFT liquid crystal panel display device according to a first embodiment of the present invention. In FIG. 1, reference number 1 denotes input terminals for image signals SY, SR, SG and SB. A/D converters 2 each sample a received image signal and hold the resultant signal, and convert it into a digital signal value. The signal values are held until the following signals are output.

A signal switching device 3 selects one of three signal values, and a signal switching device 10 selects one of two input signal values. An output signal is held until the following signal is output. A timing for selection is supplied by an external timing generator 4, which will be described in detail later. Timing generators 4 and 14 generate different timing signals from respective cycle signals that they receive. Memories 5 and 6 are employed to store one signal value that is input. When the following signal value is input, the previously stored signal value is erased. An arithmetic operation unit 7 calculates an absolute value for a difference between two received signal values. A memory 8 is used to store a threshold value that is set in advance. A comparator 9 compares a signal value output by the arithmetic operation unit 7 with the threshold value that is stored in the memory 8. A timing for performing the comparison is supplied by the timing generator 4. Reference number 11 denotes an output terminal of the switching device 10. A clock generator 12 supplies a cycle signal for the entire display device. Reference number 13 denotes an output signal terminal for the clock generator 12. A D/A converter 15 has an input buffer in which three signal values are stored, and converts each signal value in the buffer into an analog signal at a timing that is supplied by the timing generator 14. The analog signals that are output are held until the following signals are output. Reference number 18 denotes a liquid crystal panel; 16, a row electrode driving circuit of the liquid crystal panel; a column electrode driving circuit 17 of the liquid crystal panel; and 19, the block diagram of a section enclosed by the broken line.

Figure 2:
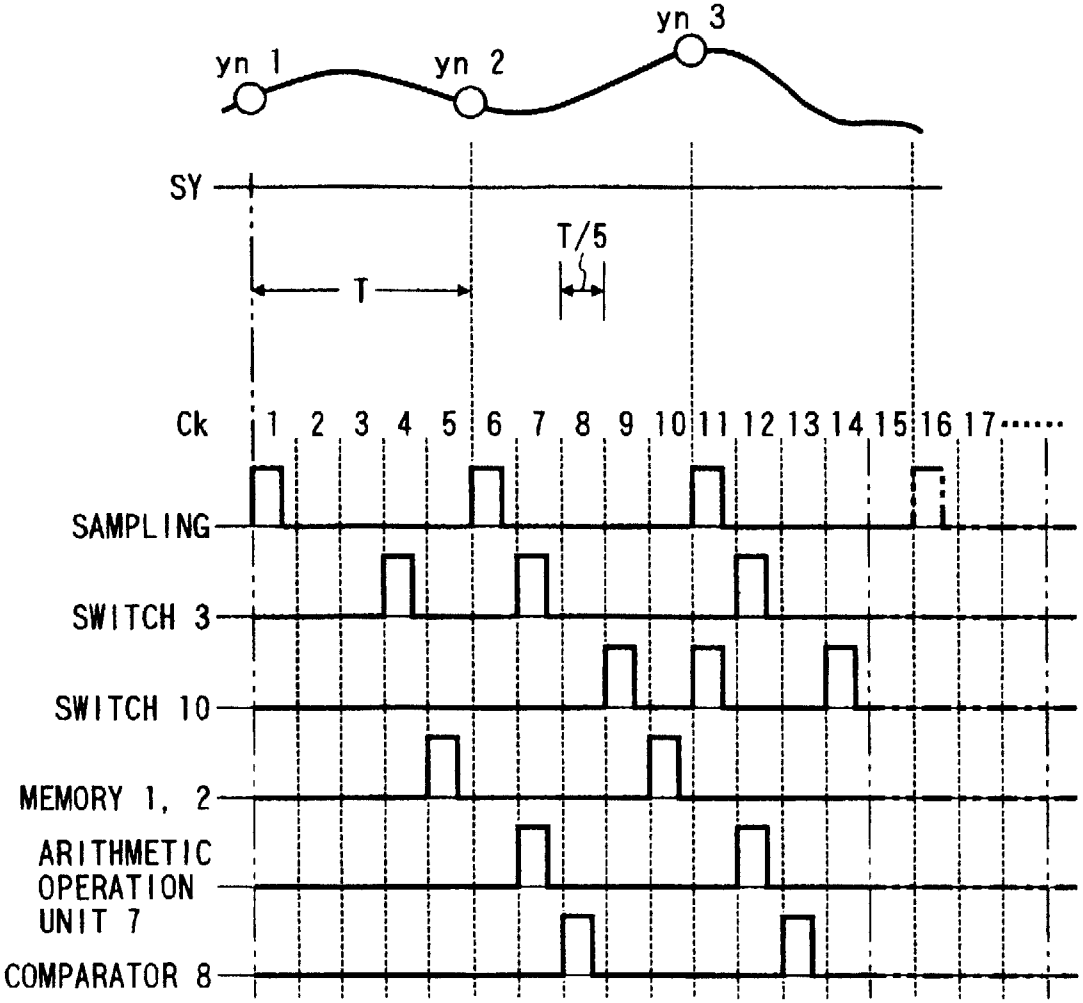
FIG. 2 is a timing chart for controlling the display device of the present invention.

FIG. 2 is a timing chart for the operations of the individual sections. A waveform shown in FIG. 2 is to be output by the timing generator 4 to the individual sections. In synchronization with this waveform, the individual sections of the display device perform signal processing. Ck1, 2, 3, . . . indicate timing counts whose numbers correspond with the numbers of the clock pulse counts. The processing will now be described while referring to FIGS. 1 and 2.

At clock (Ck) 1, sampling is performed of signals that are input at the image input terminals 1, and the resultant signals are converted into digital data by the A/D converter 15 to acquire signal values yn1, rn1, gn1 and bn1for respective signals. At Ck4, the switching device 3 selects and outputs signal value rn1 of signal SR. At Ck5, signal value yn1 for signal SY is stored in M5 and signal value rn1for signal SR is stored in M6. At Ck6, sampling of signals that are input at the image input terminals 1 is performed and the resultant signals are converted into digital data to acquire signal values yn2, rn2, gn2 and bn2 for respective signals. At Ck7, the switching device 3 selects and outputs signal value gn2 of signal SG; and the arithmetic operation unit 7 calculates as an absolute value a difference between signal values yn1 and yn2 that are stored in M5. At Ck8, the comparator 9 compares the output of the arithmetic operation unit 7 with a threshold value th that is written in advance in FR8. At Ck9, in consonance with the output of the comparator 9, the switching device 10 selects either rn1 or gn2 that is stored in M6 and outputs the selected signal value to the signal output terminal 11. This signal value is held in the input buffer of the D/A converter 15. At Ck10, signal value yn2 for signal SY is stored in M5, and signal value gn2 for signal SG is stored in M6. At Ck11, sampling of signals that are input at the image input terminals 1 is performed and the resultant signals are converted into digital data to acquire signal values yn3, rn3, gn3 and bn3 for respective signals; and the switching device 10 outputs signal value gn2 for signal SG to the signal output terminal 11. The output signal value is held in the input buffer of the D/A converter 15. At Ck12, the switching device 3 selects and outputs signal value bn3 of signal SB; and the arithmetic operation unit 7 calculates as an absolute value a difference between signal values yn2 and yn3 that are stored in M5. At Ck13, the comparator 9 compares the output of the arithmetic operation unit 7 with the threshold value th that is written in advance in FR8. At Ck14, in consonance with the output of the comparator 9, the switching device 10 selects either gn2 or bn3 that is stored in M6 and outputs the selected signal value to the signal output terminal 11. The output signal value is held in the input buffer of the D/A converter 15. The signal that is output at the signal output terminal 11 is processed by the D/A converter 15.

Figure 3:
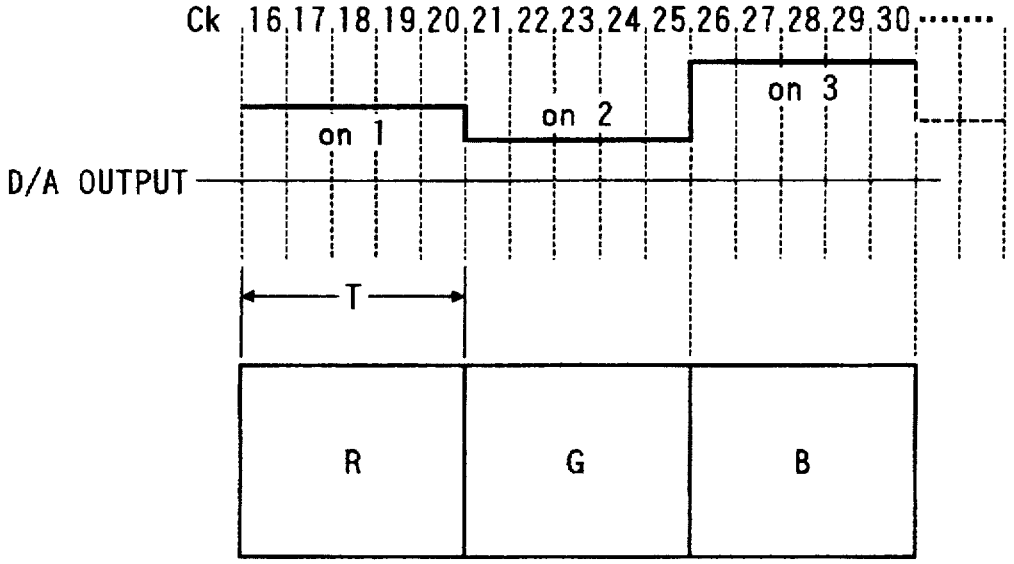
FIG. 3 is a diagram showing an output of a D/A converter.

In FIG. 3 is shown an output signal of the D/A converter 15. The output signal from the switching device 10 is stored in the input buffer of the D/A converter 15 at Ck 9, Ck11 and Ck14, and is output from the D/A converter 15 during a period extending from Ck16 through Ck30, as is shown in FIG. 3. At this time, signal levels on1, on2 and on3 are values of analog signals into which the D/A converter 15 converts digital signals that are output by the switching device 10 at Ck 9, Ck11 and Ck14. In response to the signal levels on1, on2, and on3 display pixels R, G and B are turned on.

The process at Ck1 through Ck30 is hereinafter repeated.

Figure 4:
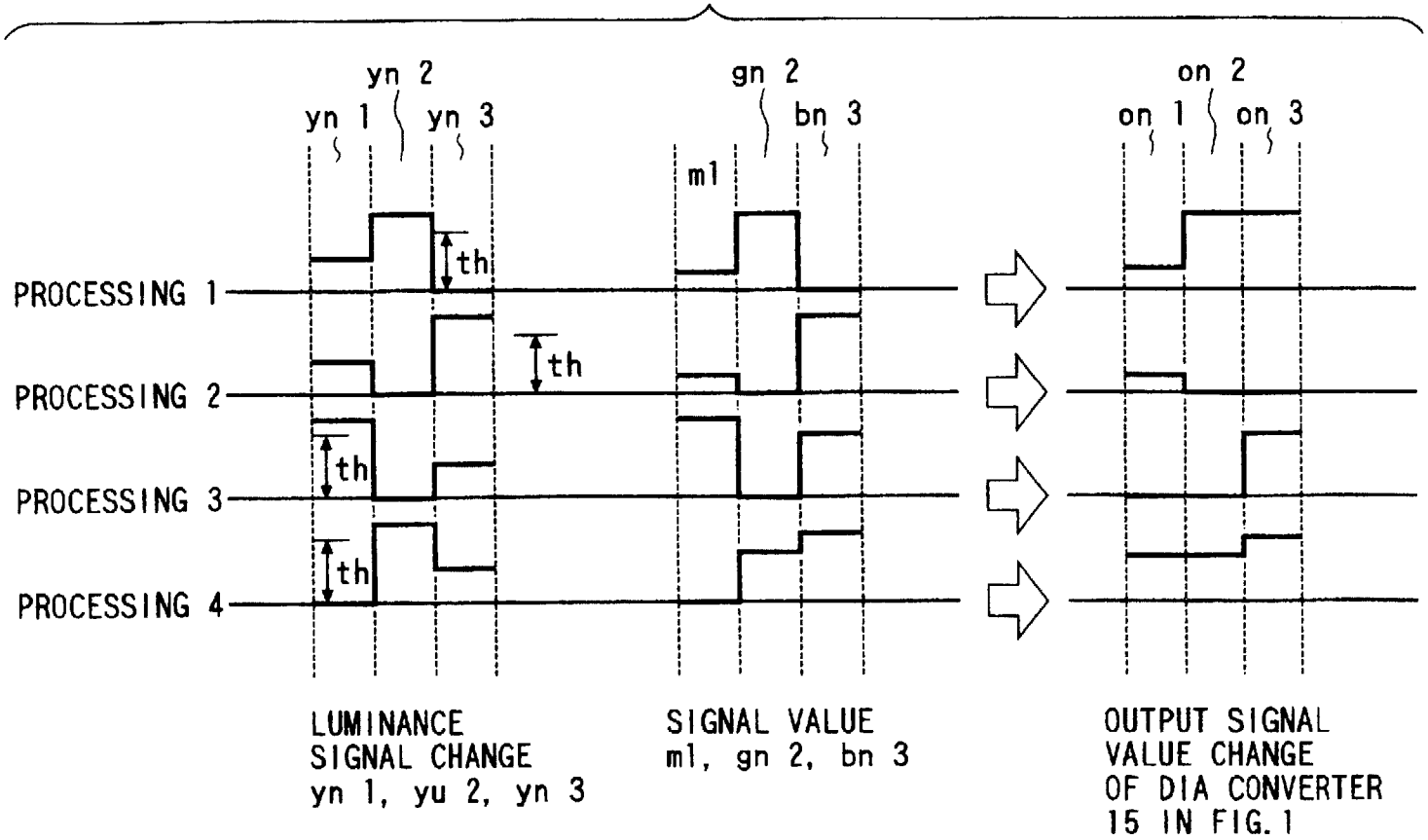
FIG. 4 is a diagram for explaining signal processing performed by the display device of the present invention.

FIG. 4 is a diagram showing specific signal process examples for comparison and selection. The notation th denotes a threshold value. These process examples will now be explained while referring to FIG. 4.

In process 1, since |yn1−yn2|<th, signal value rn1is used for displaying a red display pixel. Further, since |yn2−yn3|>th, signal value gn2 is used instead of bn3 to display a blue display pixel.

In process 2, since |yn1−yn2|<th, signal value rn1is used for displaying a red display pixel. Further, since |yn2−yn3|>th, signal value gn2 is used instead of bn3 to display a blue display pixel.

In process 3, since |yn1−yn2|>th, signal value gn2 is used instead of rn1to display a red display pixel. Further, since |yn2−yn3|<th, signal value gn3 is used to display a blue display pixel.

In process 4, since |yn1−yn2|>th, signal value gn2 is used instead of rn1to display a red display pixel. Further, since |yn2−yn3|<th, signal value gn3 is used to display a blue display pixel.

[Second Embodiment]

Figure 5:
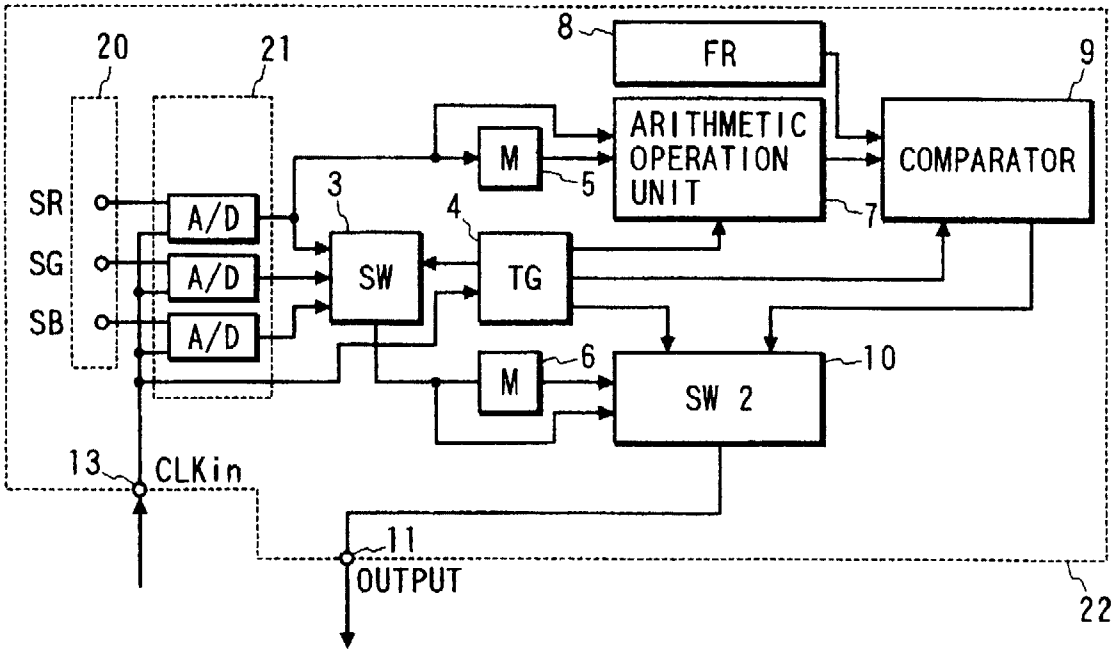
FIG. 5 is a block diagram illustrating a control system for a display device according to a second embodiment of the present invention.

FIG. 5 is a diagram illustrating a block 22, which is equivalent to the block 19 shown in FIG. 1, of the TFT liquid crystal panel display device according to a second embodiment of the present invention. The arrangements for the other blocks are the same as those in FIG. 1. In FIG. 5, reference number 20 denotes input terminals for image signals SR, SG and SB. Each of the A/D converters 21 samples a received image signal and holds the resultant signal, and converts it into a digital signal value. Although in the first embodiment signal SY is employed for an input to the comparison means, in this embodiment signal SG is used instead. Therefore, the structure for this embodiment can be simpler than that for the first embodiment.

The operation of the display device will now be described.

A waveform that is output by a timing generator 4 in the second embodiment is the same as that shown in FIG. 2. In synchronization with this waveform, the individual sections of the display device perform signal processing.

At Ck1, sampling of signals that are input at the signal input terminals 20 is performed and the resultant signals are converted into digital data to acquire signal values rn1, gn1 and bn1for respective signals. At Ck4, the switching device 3 selects and outputs signal value rn1for signal SR. At Ck5, signal value gn1 for signal SG is stored in memory 5 and signal value rn1for signal SR is stored in memory 6. At Ck6, sampling of signal that are input at the signal input terminals 20 is performed and the resultant signals are converted into digital data to acquire signal values rn2, gn2 and bn2 for respective signals. At Ck7, the switching device 3 selects and outputs signal value gn2 for signal SG; and the arithmetic operation unit 7 calculates as an absolute value a difference between signal values gn1 and gn2 that are stored in the memory 5. At Ck8, the comparator 9 compares the output of the arithmetic operation unit 7 with a threshold value th that is written in advance in memory 8. At Ck9, in consonance with the output of the comparator 9, the switching device 10 selects either rn1or gn2 that is stored in the memory 6 and outputs the selected signal value to the signal output terminal 11. This signal value is held in the input buffer of the D/A converter 15. At Ck10, signal value gn2 for signal SG is stored in the memories 5 and 6 at the same time. At Ck11, sampling of signals that are input at the image input terminals 20 is performed and the resultant signals are converted into digital data to acquire signal values rn3, gn3 and bn3 for respective signals; and the switching device 10 outputs signal value gn2 of signal SG to the signal output terminal 11. At Ck12, the switching device 3 selects and outputs signal value bn3 of signal SB; and the arithmetic operation unit 7 calculates as an absolute value a difference between signal values gn2 and gn3 that are stored in the memory 5. The output signal value is held in the input buffer of the D/A converter 15. At Ck13, the comparator 9 compares the output of the arithmetic operation unit 7 with the threshold value th that is written in advance in the memory 8. At Ck14, in consonance with the output of the comparator 9, the switching device 10 selects either gn2 or bn3 that is stored in the memory 6 and outputs the selected signal value to the signal output terminal 11. The output signal value is held in the input buffer of the D/A converter 15. The signal that is output at the signal output terminal 11 is processed by the D/A converter 15.

In FIG. 3 is shown an output signal of the D/A converter 15. The output signal from the switching device 10 is stored in the input buffer of the D/A converter 15 at Ck9, Ck11 and Ck14, and is output from the D/A converter 15 during a period extending from Ck16 through Ck30, as is shown in FIG. 3. At this time, signal levels on1, on2 and on3 are values of analog signals into which the D/A converter 15 converts digital signals that are output by the switching device 10 at Ck9, Ck11 and Ck14. In response to the signal levels on1, on2, and on3 display pixels R, G and B are turned on.

The process at Ck1 through Ck30 is hereinafter repeated.

As is described above, according to the first and the second embodiments of the present invention, a display device, comprising comparison means for comparing a difference between two signal values, which are selected from among the signal values obtained by sampling, with a predetermined threshold value, and means for, in consonance with an output of the comparison means, selectively switching a signal value that is to be provided for a display pixel, can prevent color moiré when an image is to be displayed as an input image signal is input, and can also effectively utilize for a display information concerning the input image signal.

[Third Embodiment]

Figure 6:
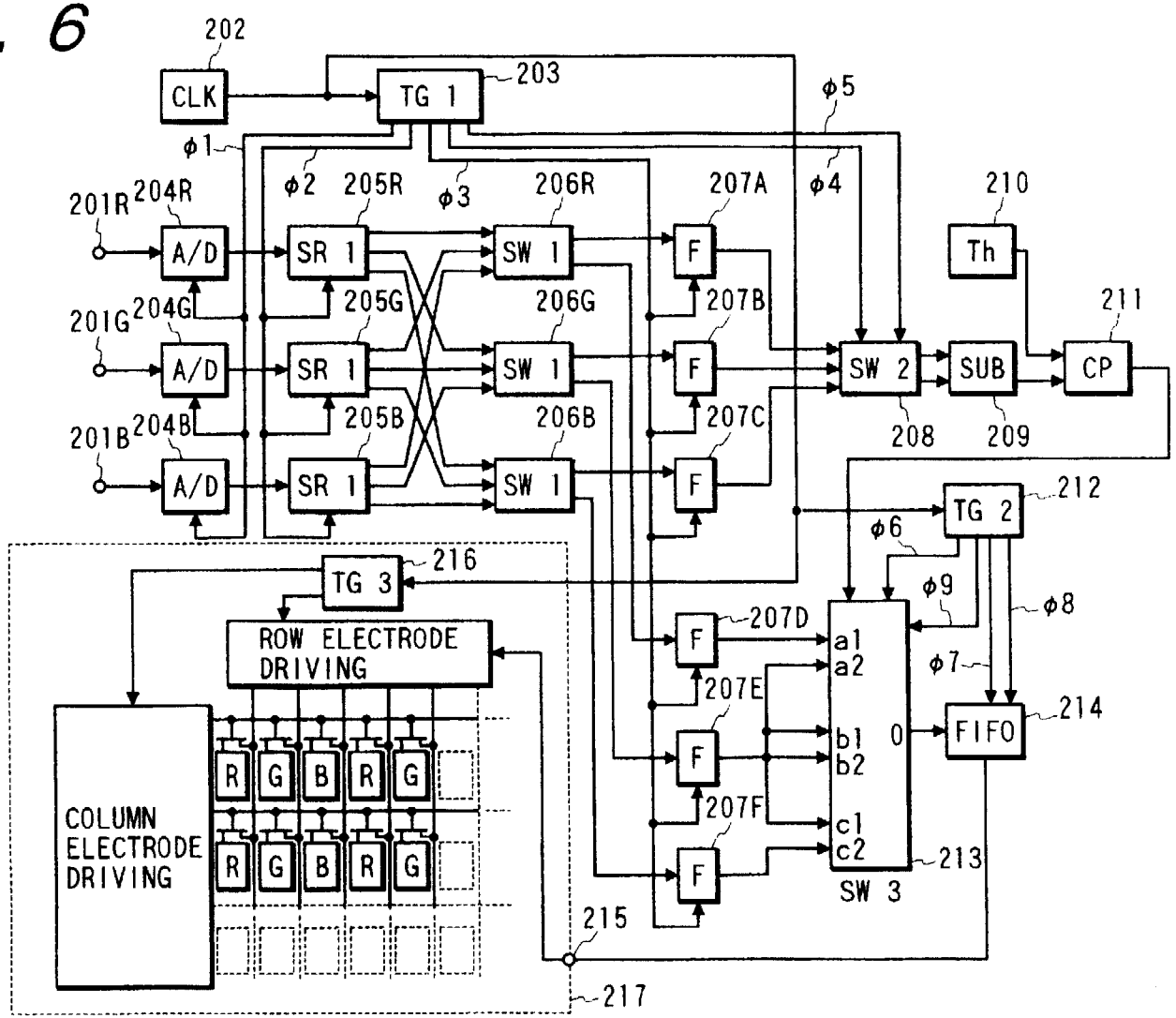
FIG. 6 is a block diagram illustrating a control system for a display device according to a third embodiment of the present invention.

FIG. 6 is a block diagram illustrating a TFT liquid crystal panel display device according to a third embodiment of the present invention. Reference numbers 201R, 201G and 201B denote input terminals for image signals SR, SG and SB. A clock generator 202 supplies a signal to a timing generator, which will be described later. A timing generator 203 supplies an operating clock to each section. A/D converters 204R, 204G and 204B holds signals obtained by sampling image signals SR, SG and SB, and converts these signals into digital signal values. These signal values are held until the following signal is output. The sampling is performed synchronously with signal ϕ1, which is supplied from the timing generator 203. Shift registers 205R, 205G and 205B store in order three signal values that are output at a predetermined time interval from the A/D converters 204R, 204G and 204B, and output them at the same time from three output terminals. The values for input signals on which sampling is performed at different times can be obtained from the output terminals. The shift operation is performed synchronously with signal ϕ2, which is supplied by the timing generator 203. Signal switching devices 206R, 206G and 206B each select and output two arbitrary signals, each of which may correspond to one selected by another switching device. Flip-flops 207A through 207F hold data for the selected signals in synchronization with the rise of signal ϕ3, which is supplied by the timing generator 203. From among the three signals that are received from the flip-flops 207A, 207B and 207C, a signal switching device 208 selects and outputs two signals in synchronization with signals ϕ4 and ϕ5 that are received from the timing generator 203. A subtracter 209 that calculates as an absolute value a difference between the two input signals. A ROM 210 is provided in which is stored a threshold value that is set in advance. A comparator 211 compares a signal from the subtracter 209 with a signal from the ROM 210 and outputs the result of the comparison. A timing generator 212 supplies signals to a signal switching device 213 and an FIFO memory 214, which will be described later. The signal switching device 213 has three signal switching element pairs, a, b and c, each of which selects and outputs one signal of the two that are input. The signal switching device 213 has an internal counter, and switches the input signals in the order represented by the letters of the signal switching elements a, b and c. The signal switching in the signal switching device 213 is controlled by using an output signal of the comparator 211, and is performed in synchronization with signal ϕ6, which is supplied by the timing generator 212. The internal counter is reset by using signal ϕ9, which is supplied by the timing generator 212. The FIFO memory 214 stores a signal in synchronization with signal ϕ7, which is supplied by the timing generator 212, and outputs the stored signal in synchronization with signal ϕ8, which is supplied by the timing generator 212. Reference number 215 denotes a signal terminal. A timing generator 216 supplies a synchronization signal to a column electrode driving circuit and a row electrode driving circuit that, together with the timing generator 216, are provided in a liquid crystal panel 217, which is a block enclosed by broken lines.

Figure 7:
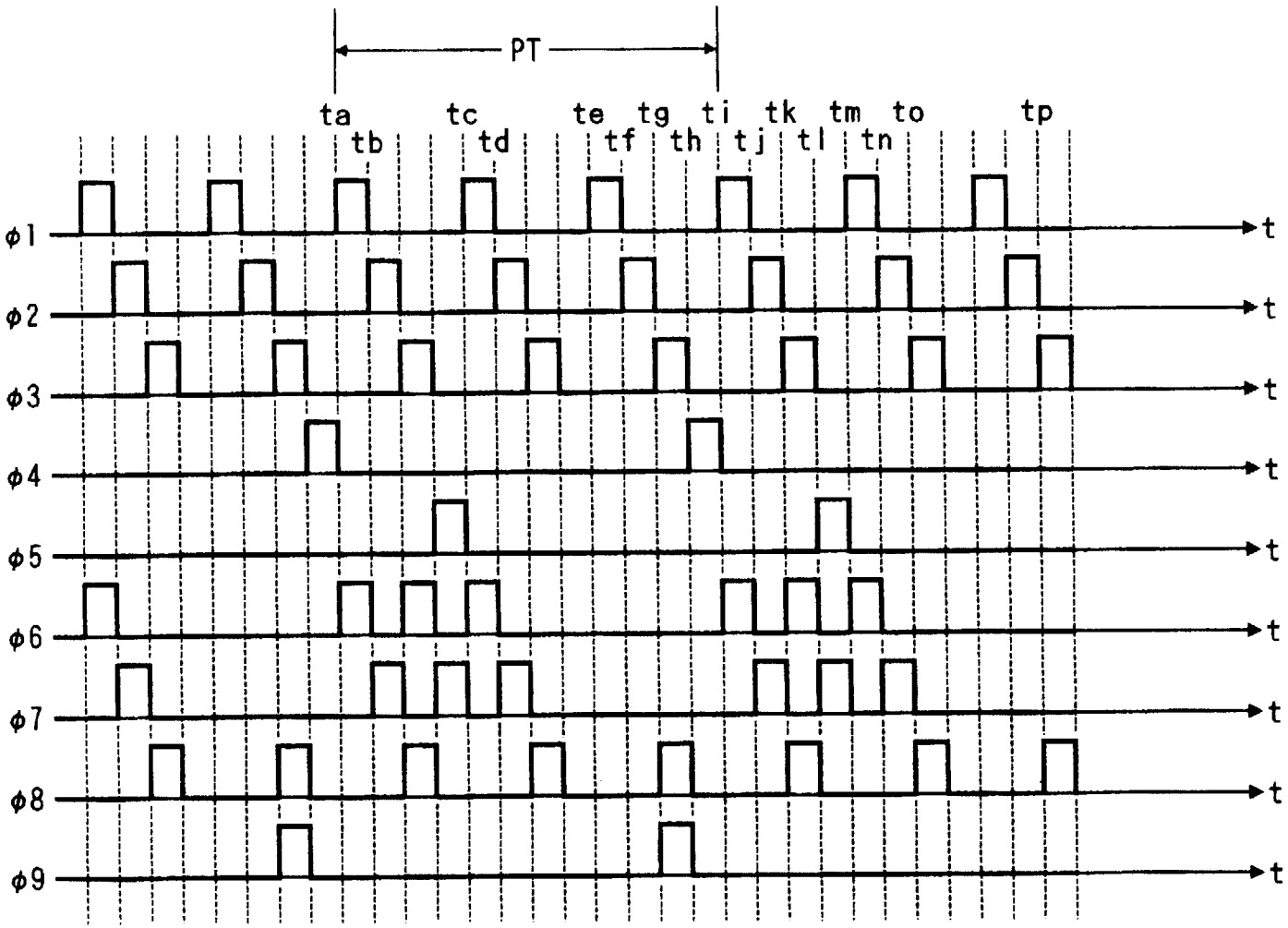
FIG. 7 is a diagram showing an output of a timing generator.

FIG. 7 is a timing chart for signals ϕ1 through ϕ9 that are output by the timing generators 203 and 212. The individual sections of the display device perform signal processing synchronously with these waveforms.

First, at time ta, upon receipt of signal ϕ1 from the timing generator 203, the A/D converters 204R, 204G and 204B each sample signals that are input at the respective terminals 201R, 201G and 201B, and hold the resultant signals. These signals that are obtained by sampling correspond to signal values r1, g1 and b1.

At time tb, upon receipt of signal ϕ2 from the timing generator 203, the shift registers 205R, 205G and 205B store and shift signals that are output from the A/D converters 204R, 204G and 204B, respectively.

During periods between times tc and td, and between te and tf, the A/D converters 204R, 204G and 204B, and the shift registers 205R, 205G and 205B perform the above described operation. Through this process, the shift register 205R transmits signal value r1, r2 and r3 to the signal switching device 206R; the shift register 205G transmits signal values g1, g2 and g3 to the signal switching device 206G; and the shift register 205B transmits signal values b1, b2 and b3 to the signal switching device 206B. From among the three signal values that are received, each of the signal switching devices 206R, 206G and 206B selects two predetermined signal values, each of which may correspond to a signal value selected by another switching device. In this embodiment, it is assumed that the signal switching device 206R is so set to output signal value r1, the signal switching device 206G is set to output signal value g2, and the signal switching device 206B is set to output signal value b3.

At time tg, in synchronization with signal ϕ3, which is supplied by the timing generator 203, the flip-flops 207A through 207F hold and output signal values that are received from the signal switching devices 206R, 206G and 206B. In this embodiment, according to the above assumption, the flip-flops 207A, 207B, 207C, 207D, 207E and 207F hold the respective signal values r1, g2, b3, r1, g2 and b3. The flip-flops 207A through 207C output their signal values to the signal switching device 208.

At time th, in synchronization with signal ϕ4 from the timing generator 203, the signal switching device 208 selects two given signals from among the signals that are received from the flip-flops 207A, 207B and 207C. In this embodiment it is assumed that the signal switching device 208 is set in advance to select signal value r1 from the flip-flop 207A and signal value g2 from the flip-flop 207B in response to signal ϕ4. The subtracter 209 calculates as an absolute value a difference between the two signal values r1 and g2, which are selected by the signal switching device 208, and outputs the absolute value. The comparator 211 compares the output of the subtracter 209 with the threshold value Th of the ROM 210, and outputs the result of the comparison. The comparator 211 determines whether the output of the subtracter 209>Th is established, i.e., "true" or "false", and outputs the result as a binary signal. When this condition is established, the comparator 211 outputs a "true" signal.

At time ti, if the signal received from the comparator 211 is "true", the signal switching device 213 selects the input terminal a2 of the signal switching device 213. If the received signal is "false", the switching device 213 selects the input terminal a2. The result of a selection is transmitted to the output terminal O. This selection process is performed in synchronization with the receipt of signal ϕ6 from the timing generator 212. When the output of the comparator 211 is "true", signal value r1 is input at the input terminal a1 of te signal switching device 213, signal value g2 is input at the input terminal a2, and r1 is sent to the output terminal O. In this case, presume that r1 is output from the output terminal O.

At time tj, in response to signal ϕ7 from the timing generator 212, the FIFO memory 214 stores signal value r1, which is output by the signal switching device 213.

At time tk, the signal switching device 213 forwards the signal value from the input terminal b2 to the output terminal O. At this time, the output of the comparator 211 is not employed. Signal value g2 is selected in this embodiment. At the same time, at time tk, the FIFO memory 214 outputs signal value r1, which was stored at time tj, and holds the output signal value until time to. The signal that is output by the FIFO memory 214 passes through the terminal 215 and is displayed on the liquid crystal panel 217.

At time t1, in synchronization with signal ϕ5 from the timing generator 203, the signal switching device 208 selects and outputs two given signals from among the signals that are received from the flip-flops 207A, 207B and 207C. In this embodiment, it is assumed that the signal switching device 208 is set in advance to select signal values that are output by the flip-flops 207B and 207C in response to signal ϕ5. Thus, the signal switching device 208 outputs signal values g2 and b3. At the same time, at time t1, upon receipt of signal ϕ7 from the timing generator 212, the FIFO memory 214 stores signal value g2 that is selected by the signal switching device 213.

At time tm, in consonance with a "true" signal or a "false" signal that is received from the comparator 211, the signal switching device 213 selects a signal value input at either the input terminal c1 or c2 of the signal switching device 213, and outputs it to the output terminal O. This selection is performed in synchronization with signal ϕ6, which is supplied by the timing generator 212. In this embodiment, it is assumed that signal value g2 is input at the input terminal c1 of the signal switching device 213, signal b3 is input at the input terminal c2, and g2 is forwarded to the output terminal O.

At time tn, the FIFO memory 214 stores signal value g2 from the signal switching device 213 (a signal value that was selected at time tm) in response to signal ϕ7, which is supplied by the timing generator 212.

At time to, the FIFO memory 214 outputs signal value g2 that was stored at time t1, and maintains the output signal value until time tp. The output signal value is displayed on the liquid crystal panel 217.

At time tp, the FIFO memory 214 outputs signal value g2 that was stored at time tn. The output signal value is displayed on the liquid crystal panel 217.

The above described process is repeated during cycle PT. The relationship between times T and PT is PT=3T.

[Fourth Embodiment]

Figure 8:
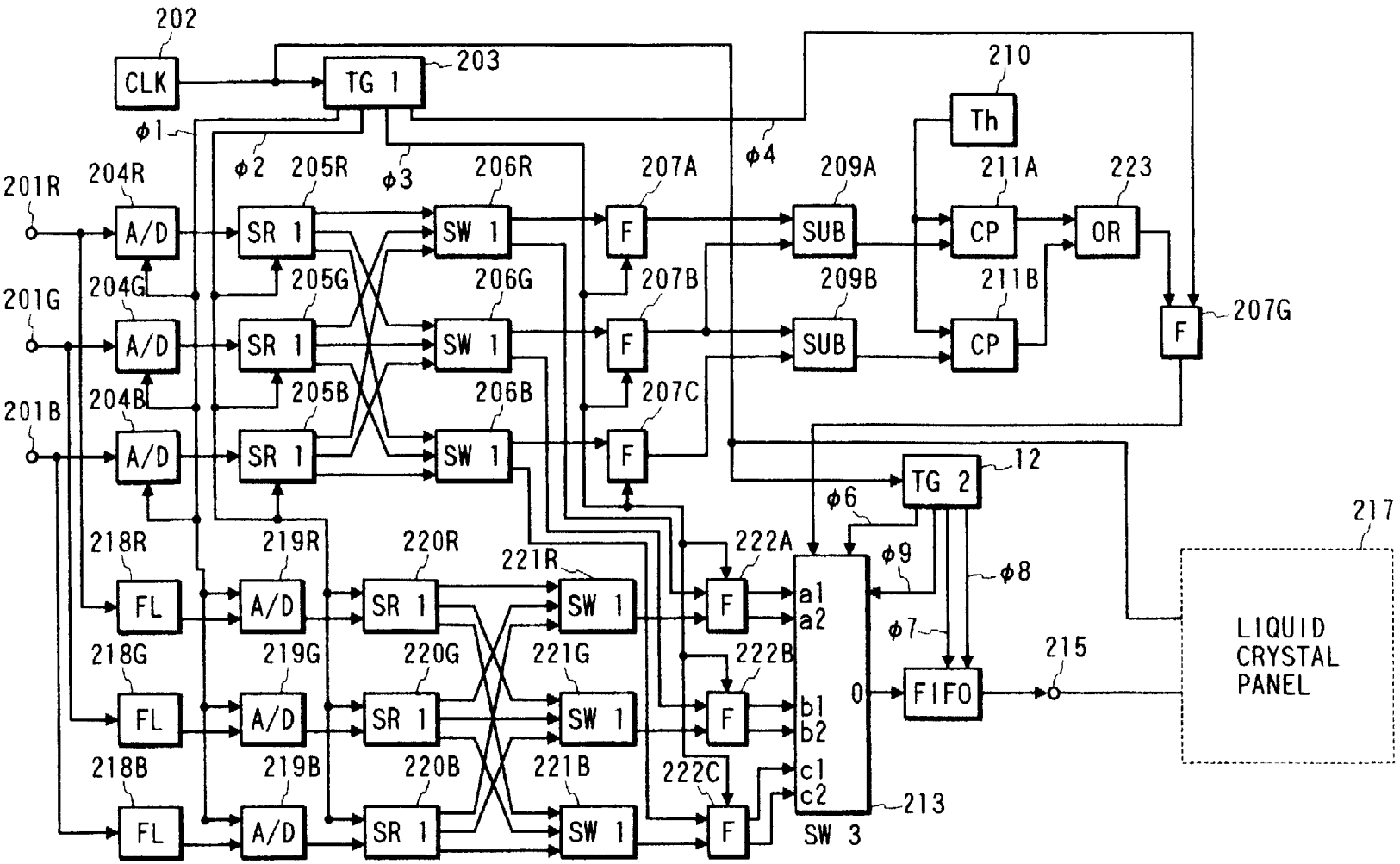
FIG. 8 is a block diagram illustrating a control system for a display device according to a fourth embodiment of the present invention.

FIG. 8 is a block diagram illustrating the arrangement of a display device according to a fourth embodiment of the present invention. The fourth embodiment will now be described while referring to FIGS. 7 and 8. The same reference numbers as are used in FIG. 6 are also used in FIG. 8 to denote corresponding or identical components. In FIG. 8, signal filters 218R, 218G and 218B perform predetermined filtration of signals that are input at signal input terminals 201R, 201G and 201B, respectively. A/D converters 219R, 219G and 219B hold signal values that are obtained by sampling signals that are output by the respective signal filters 218R, 218G and 218B, and convert the signals into digital signal values. The signal values are held until the following signals are output. Sampling is performed in synchronization with signal ϕ1, which is supplied by a timing generator 203. Shift registers 220R, 220G and 220B function the same as the shift registers 205R, 205G and 205B. Signal switching devices 221R, 221G and 221B each select, from among three received signal values, one signal value that is determined in advance, and output the selected signal value. Flip-flops 222A, 222B and 222C have two input terminals and two output terminals, and hold data in synchronization with the rise of signal ϕ3, which is supplied by the timing generator 203. The flip-flops 222A, 222B and 222C hold the outputs of signal switching devices 206R, 206G and 206B, and the outputs of the signal switching devices 221R, 221G and 221B, respectively.

The operation of the display device in the fourth embodiment will now be described while referring to FIGS. 7 and 8.

First, at time ta, upon receipt of signal ϕ1 from the timing generator 203, the A/D converters 204R, 204G and 204B each sample signals input at the respective terminals 201R, 201G and 201B, and hold the resultant signals. At the same time, the A/D converters 219R, 219G and 219B each sample the respective output of the signal filters 218R, 218G and 218B, and hold the resultant signals.

At time tb, upon receipt of signal ϕ2 from the timing generator 203, the shift registers 205R, 205G and 205B store and shift signals that are output by the A/D converters 204R, 204G and 204B, respectively. At the same time, the shift registers 220R, 220G and 220B store and shift values of signals that are output by the A/D converters 219R, 219G and 219B, respectively.

During periods between times tc and td, and between te and tf, the A/D converters 204R, 204G, 204B, 219R, 219G and 219B, and the shift registers 205R, 205G, 205B, 220R, 220G and 220B perform the above described operation. Through the above process, the shift register 205R outputs signal values r1, r2 and r3; the shift register 205G outputs signal values g1, g2 and g3; and the shift register 205B outputs signal values b1, b2 and b3. Similarly, the shift register 220R outputs signal value Fr1, Fr2 and Fr3; the shift register 220G outputs signal values Fg1, Fg2 and Fg3; and the shift register 220B outputs signal values Fb1, Fb2 and Fb3. From among the three received signal values, each of the signal switching devices 206R, 206G and 206B selects two signal values, each of which may correspond to a signal value selected by another switching device. Likewise, each of the signal switching devices 221R, 221G and 221B selects one signal value from among three received signal values. In this embodiment, it is assumed that the signal switching device 221R selects signal value Fr1, the signal switching device 221G selects signal value Fg2, and the signal switching device 221B selects signal value Fb3.

In synchronization with signal $\phi 3$, which is supplied by the timing generator 203, the flip-flops 207A, 207B and 207C maintain, from time tg, signal values that are received from the signal switching devices 206R, 206G and 206B, and output them. In this embodiment, assume that the flip-flops 207A, 207B and 207C hold the respective signal values r1, g2 and b3, and output them. Further, in synchronization with signal $\phi 3$, which is supplied by the timing generator 203, the flip-flops 222A, 222B and 222C maintain, from time tg, signal values that are received from the signal switching devices 206R, 206G and 206B, and signal values that are received from the signal switching devices 221R, 221G and 221B, and output them. In this embodiment, in consonance with the above assumption, the flip-flop 222A holds and outputs signal values r1 and Fr1; the flip-flop 222B holds and outputs signal values g2 and Fg2; and the flip-flop 222C holds and outputs signal values b3 and Fb3. The subtracter 209A calculates absolute difference $|r1-g2|$ between the signal values that are output from the flip-flops 207A and 207B; and the subtracter 209B calculates absolute difference $|g2-b3|$ between the signal values that are output from the flip-flops 207B and 207C. The comparator 211A compares the output of the subtracter 209A and threshold value Th of the ROM 210, and outputs the result as a "true" or "false" binary signal. When the signal value output from the subtracter 209A>threshold value Th, a "true" signal is output. In other cases, a "false" signal is output. Similarly, the comparator 211B compares the output of the subtracter 209B and threshold value Th of the ROM 210, and outputs the result as a "true" or "false" binary signal. A logic arithmetic unit 223 calculates a logical sum for the signals that are provided by the comparators 211A and 211B, and outputs the result. When one of the results provided by the comparators 211A and 211B is "true", the output of the logic-arithmetic unit 223 is "true".

At time th, the output of the logic-arithmetic unit 223 is held in the flip-flop 207G in synchronization with control signal $\phi 4$, and is output.

At times ti, tk and tm, in consonance with a "true" signal or a "false" signal from the flip-flop 207G, the signal switching device 213 selects a set of the input terminals a1, b1 and c1 of the signal switching device 213, or a set of the input terminals a2, b2 and c2. That is, when the output of the flip-flop 207G is "true", the signal switching device 213 selects the input terminals a2, b2 and c2 and sequentially outputs the signal values from the terminals in synchronization with signal $\phi 6$, which is supplied by the timing generator 212. When the output of the flip-flop 207G is "false", the signal switching device 213 selects the input terminals a1, b1 and c1, and sequentially outputs signal values in synchronization with signal $\phi 6$, which is supplied by the timing generator 212. Assume that the output of the flip-flop 207G is "true" and that signal value r1 input to the input terminal al of the signal switching device 213 and signal value Fr1 is input to the input terminal a2. In other words, suppose that the signal value output by the subtracter>threshold Th is established. Then, at time ti, signal value Fr1, which is input at the input terminal a2 of the signal switching device 213, is sent to the output terminal O.

At time tj, in response to signal $\phi 7$ from the timing generator 212, the FIFO memory 214 stores signal value r1 that is output by the signal switching device 213.

At time tk, in synchronization with signal $\phi 6$, the signal switching device 213 selects the input terminal b2 from among the two input terminals, b1 and b2, of the signal switching device 213. Since signal value Fg2 is input at the input terminal b2, the signal switching device 213 forwards the signal value Fg2 to the output terminal O. In the manner as previously described, at time tk, the FIFO 214 outputs signal value Fr1, which was stored at time tj, and maintains the output signal value until time to. The output signal value passes through the terminal 215 and is displayed on the liquid crystal panel 217.

At time t1, in response to signal $\phi 7$ from the timing generator 212, the FIFO memory 214 stores signal value Fg2, which is output by the signal switching device 213.

At time tm, in synchronization with signal $\phi 6$, the signal switching device 213 selects the input terminal c2 from among the two input terminals, c1 and c2, of the signal switching device 213. Since signal value Fb3 is input at the input terminal b2, the signal switching device 213 forwards the signal value Fb3 to the output terminal O.

At time tn, in response to signal $\phi 7$ from the timing generator 212, the FIFO memory 214 stores signal value Fb3, which is output by the signal switching device 213 (the signal value that was selected at time tm).

At time to, the FIFO 214 outputs signal value g2, which was stored at time t1, and maintains the output signal value until time tp. The output signal value is displayed on the liquid crystal panel 217.

At time tp, the FIFO 214 outputs signal value g2, which was stored at time tn. The output signal value is displayed on the liquid crystal panel 217.

The above described process is repeated during cycle PT. The relationship between time T and PT is PT=3T.

In this embodiment, an input image signal is greatly varied during a unit of time, and when the degree of its change exceeds a predetermined value, an image signal that is to be output to the liquid crystal panel 217 is partially switched. When the signal filters 218R, 218G and 218B are low-pass filters, filtering can be selectively performed in a region within a received image in which moiré tends to appear. Therefore, processing for reducing moiré can be performed while information carried by the input image signal is maintained.

As is described above, according to the display device of the present invention, at times t1, t2 and t3 ($t1<t2<t3$), sampling of signals is performed for controlling red, green and blue display pixels; and signal values rn1, rn2 and rn3; gn1, gn2 and gn3 ; and bn1, bn2 and bn3 are acquired. When a signal value is selected from these signal values and is provided for three red, green, and blue pixels that are sequentially arranged, a difference between rn1 and rn2, a difference between gn1 and gn2, or a difference between bn1 and bn2 is compared with a predetermined threshold value Th. When each difference>Th, a signal value that is to be provided for the display pixels is switched. In this manner, color moiré in an image can be reduced, and information carried by an input image signal can be satisfactorily displayed.

Further, a signal value that is to be provided to a pixel array in the display device is switched in consonance with the change in the amplitude of an input image signal. At this time, when either a signal value obtained by performing predetermined filtering of an input signal, or a signal value of an input image signal obtained without filtering, is switched, signal filtering can be selectively performed only for a region of an input image in which color moiré tends to appear, and information carried by the input image signal can be effectively utilized.

[Fifth Embodiment]

Figure 9:
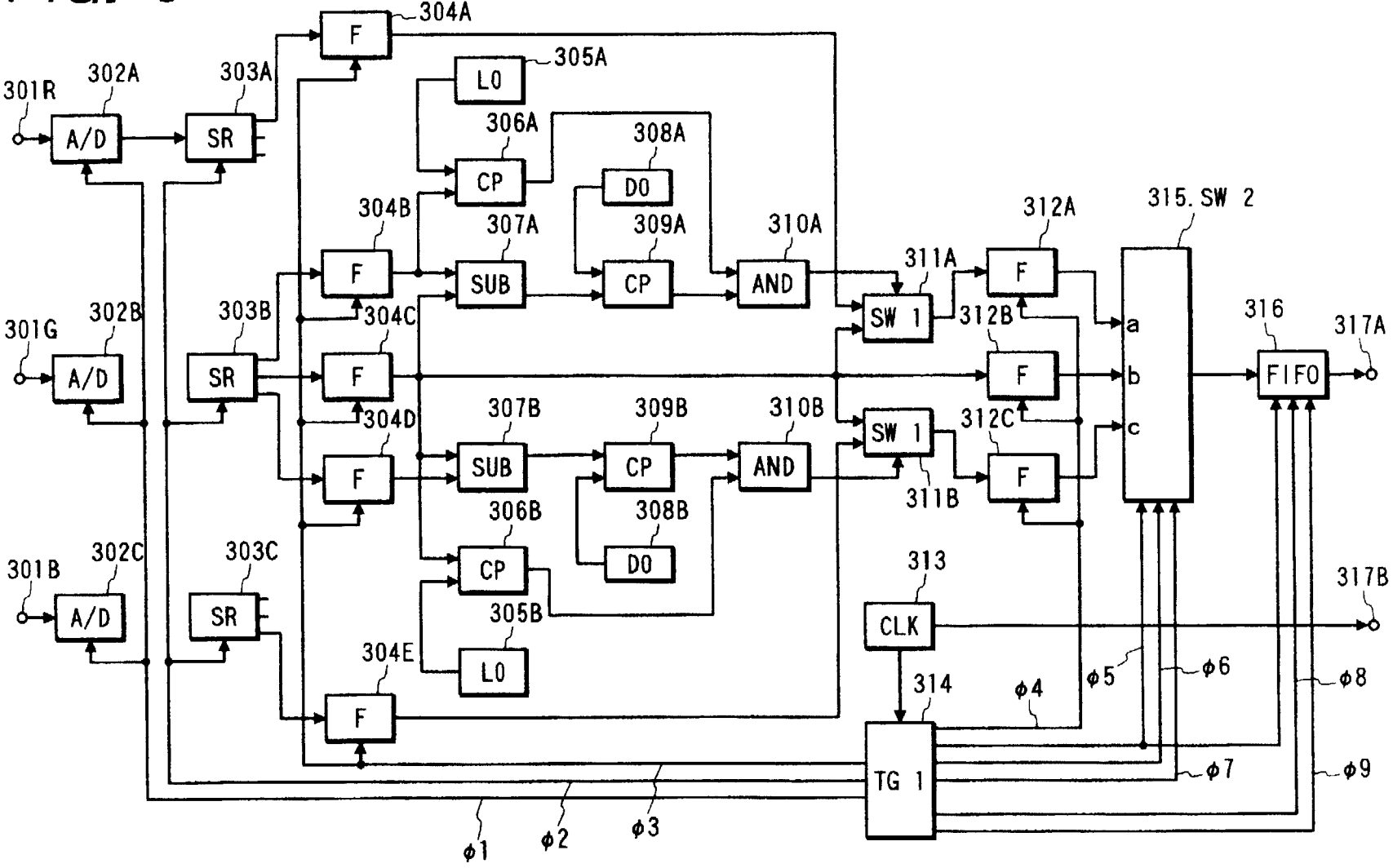
FIG. 9 is a block diagram illustrating a control system for a display device according to a fifth embodiment of the present invention.
Figure 10:
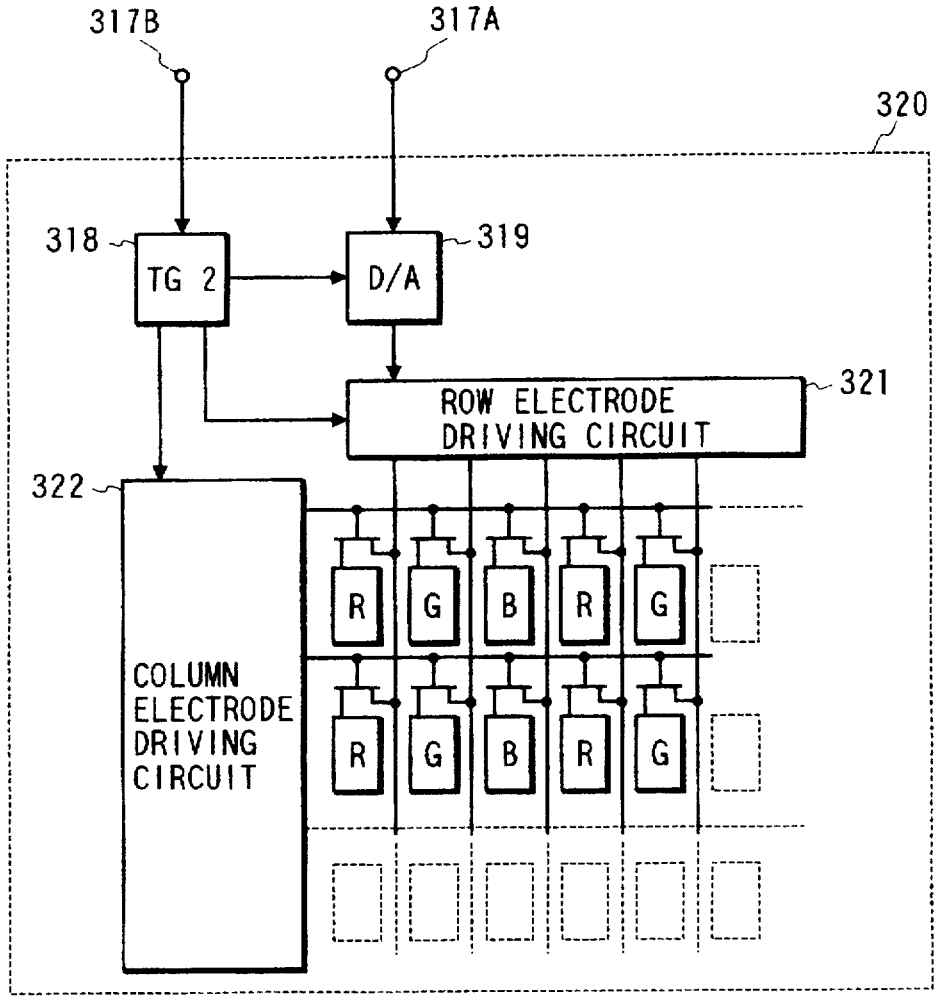
FIG. 10 is a block diagram illustrating the arrangement of a display element according to the present invention.
Figure 11:
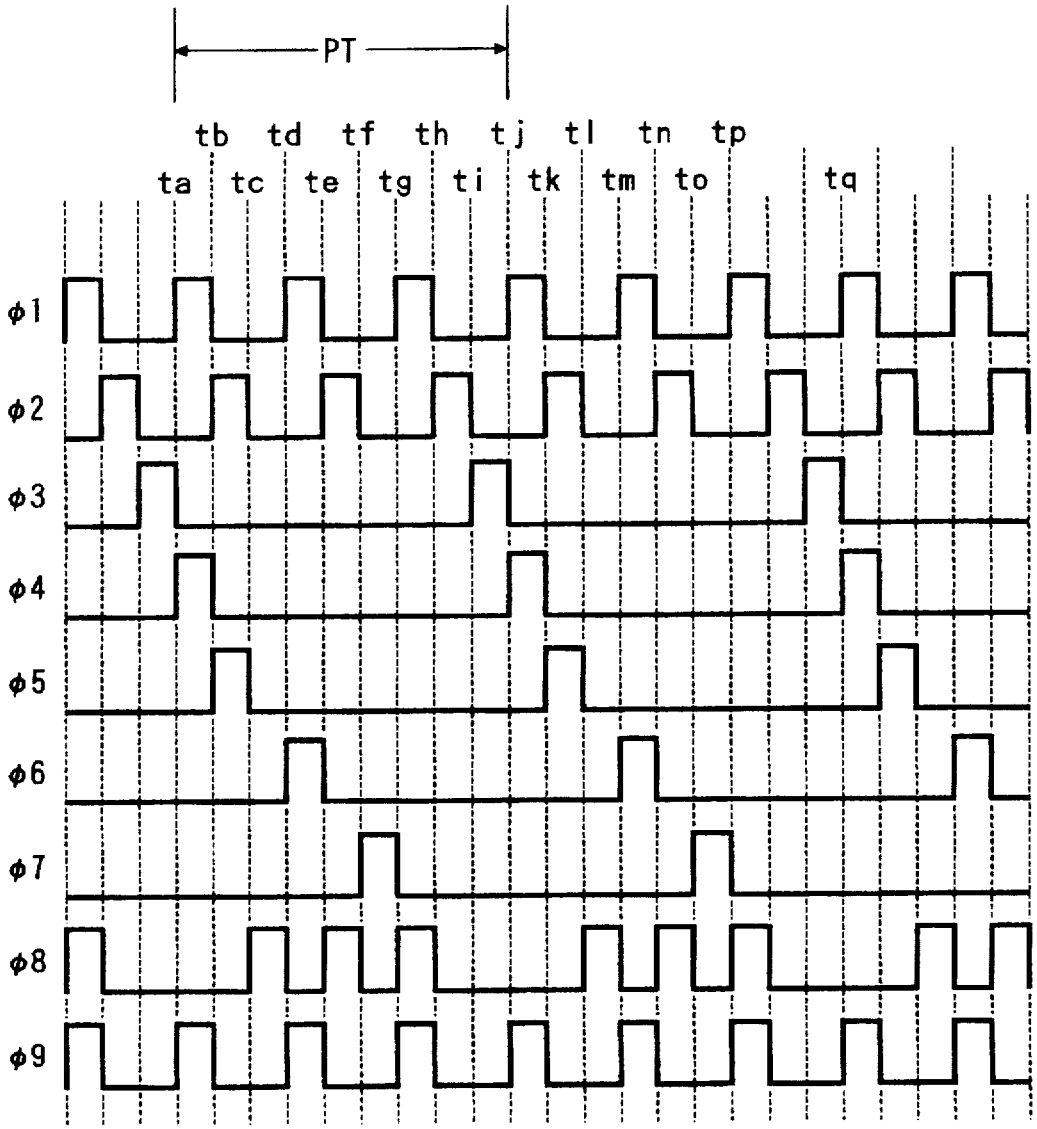
FIG. 11 is a diagram showing an output of a timing generator.

FIG. 9 is a block diagram illustrating the arrangement of a display device according to a fifth embodiment of the present invention, and FIG. 10 is a block diagram illustrating a liquid crystal panel that is connected to the display device shown in FIG. 9. In FIG. 9, image signals SR, SG and SB for controlling the luminance of red, green and blue display pixels are input at respective image input terminals 301R, 301G and 301B. A/D converters 302A, 302B and 302C each sample and hold the input image signals SR, SG and SB and convert them into digital signal values. The signal values are held until the following signals are input. Sampling is performed in synchronization with signal ϕ1, which is supplied by a timing generator that will be described later. Shift registers 303A, 303B and 303C sequentially store three signal values that are output at a predetermined time interval by the respective A/D converters 302A, 302B and 302C, and output them at their output terminals at the same time. From these three output terminals are acquired values that are obtained by sampling the input image signals at different times. The shift operation is performed in synchronization with signal ϕ2, which is supplied by a timing generator. Flip-flops 304A through 304E each store an input signal in synchronization with signal ϕ3, which is supplied from a timing generator. Memories 305A and 305B are used in which a predetermined signal value L0 is stored. Comparators 306A and 306B compare respectively the signals in the memories 305A and 306A with signals input to the flip-flops 304B and 304C, and output a signal of "1" or "0" as a result of each comparison. Subtracters 307A and 307B calculate and output, as absolute values, a difference between a signal to the flip-flop 304B and a signal to the flip-flop 304C, and a difference between a signal input to the flip-flop 304C and a signal input to the flip-flop 304D. Memories 308A and 308B are employed in which a predetermined value D0 is stored. Comparators 309A and 309B compare respectively the signal values in the memories 308A and 308B with the signal values output by the subtracters 307A and 307B. Logic-arithmetic units 310A and 310B calculate and output a logical product of signal values that are output by the comparators 306A and 309A, and by the comparators 306B and 309B. Signal switching devices 211A and 311B each select one of two input signals by using a received control signal, and output the selected signal. Flip-flops 312A, 312B and 312C hold input signals in synchronization with signal ϕ4, which is supplied by a timing generator. A clock generator 313 supplies a signal to a timing generator. A timing generator 314 employs a signal received from the clock generator 313 to generate and output a timing clock that is to be transmitted to the individual sections of the display device. A signal switching device 315 selects one signal from input signals a, b and c by using a control signal that is received from the timing generator 314. Input a is selected at the rise of the waveform of control signal ϕ5, input b is selected at the rise of the waveform of control signal ϕ6, and input c is selected at the rise of the waveform of control signal ϕ7. FIG. 11 is a diagram showing waveforms for control signals ϕ5, ϕ6 and ϕ7. An FIFO memory 316 is used, in which input signal values are sequentially stored in synchronization with control signal 48 that is supplied by the timing generator 314, and from which the signal values are sequentially output in synchronization with control signal ϕ9. In synchronization with control signal ϕ5, the contents of the FIFO memory 316 are reset. Reference number 317A denotes an output terminal of the FIFO memory 316, and 317B, an output terminal of the clock generator 313. These terminals are the same as the terminals 317A and 317B in FIG. 10.

In FIG. 10, a timing generator 318 generates a timing clock by using a clock that is supplied to the terminal 317B by the clock generator 313. A D/A converter 319 converts a signal output by the FIFO memory 316 into an analog signal. The signal obtained by conversion is transmitted to a row electrode driving circuit 321 in the liquid crystal panel 320. The liquid crystal panel 320 includes the timing generator 318 and the D/A converter 319.

FIG. 11 is a timing chart showing a time-transient change for control signals ϕ1 through 9, which are transmitted from the timing generator 314 in FIG. 9.

First, at time ta, upon receipt of signal ϕ1 from the timing generator 314, each of the A/D converters 302A, 302B and 302C sample signals that are input at the respective terminals 301R, 301G and 301B, and hold the resultant signals. These signals that are obtained by sampling correspond to signal values r1, g1 and b1 in FIG. 35.

At time tb, upon receipt of signal ϕ2 from the timing generator 314, the shift registers 303A, 303B and 303C respectively store and shift signals that are output by the A/D converters 302A, 302B and 302C.

During the periods between times td and tf, and between tg and ti, the A/D converters 302A, 302B and 302C, and the shift registers 303A, 303B and 303C perform the above described operation. Through this process, the shift register 303A transmits signal values r1, r2 and r3 to the flip-flop 304A; the shift register 303B transmits signal values g1, g2 and g3 to the flip-flops 304B through 304D; and the shift register 303C transmits signal values b1, b2 and b3 to the flip-flop 304E.

At time ti, in synchronization with signal ϕ3, which is supplied by the timing generator 314, the flip-flops 304A through 304E hold and output signal values that are output by the shift registers 303A, 303B and 303C. In this embodiment, the flip-flops 304A, 304B, 304C, 304D and 304E hold the respective signal values r1, g1, g2, g3 and b3. The comparator 306A compares signal value g1 of the flip-flop 304B with signal value L0 in the memory 305A, and outputs the result. When signal value g1 of the flip-flop 304B<L0, the comparator 306A outputs a signal of "1". When such a condition is not established, the comparator 306A outputs a signal of "0". The comparator 306B compares signal value g2 of the flip-flop 304C with signal value L0 the memory 305B. When signal value g2 of the flip-flop 304C<L0, the comparator 306B outputs a signal of "1". When such a condition is not established, the comparator 306A outputs a signal of "0". The subtracter 307A calculates as an absolute value a difference between signal value g1 of the flip-flop 304B and signal value g2 of the flip-flop 304C, and outputs the absolute value. The subtracter 307B calculates as an absolute value a difference between signal value g2 of the flip-flop 304C and signal value g3 of the flip-flop 304D, and outputs the absolute value. The comparator 309A compares signal value |g1−g2| of the subtracter 307A with signal value D0 in the memory 308A, and outputs the result. When signal value |g1−g2| of the subtracter 307A>D0, the comparator 309A outputs a signal of "1". When such a condition is not established, the comparator 309A outputs a signal of "0". The comparator 309B compares signal value |g2−g3| of the subtracter 307B with signal value D0 in the memory 308B, and outputs the result. When signal value |g2−g3| of the subtracter 307B>D0, the comparator 309B outputs a signal of "1". When such a condition is not established, the comparator 309B outputs a signal of "0". The logic-arithmetic unit 310A calculates a logical product of the output of the comparator 306A and the output of the comparator 309A, and outputs a signal of "1" or "0". The logic-arithmetic unit 310B calculates a logical product of the output of the comparator 306B and the output of the comparator 309B, and outputs a signal of "1" or "0". In consonance with the output of the logic-arithmetic unit 310A, the signal switching device 311A selects signal value r1 output by the flip-flop 304A or signal value g2 output by the flip-flop 304C, and outputs the selected signal value. In consonance with the output of the logic-arithmetic unit 310B, the signal switching device 311B selects signal value b3 output by the flip-flop 304E or signal value g2 output by the flip-flop 304C, and outputs the selected signal value.

At time tj, the flop-flops 312A, 312B and 312C store input signals in synchronization with signal ϕ4, which is supplied by the timing generator 314. The flip-flop 312A stores the output of the signal switching device 311A, the flip-flop 312B stores the output of the flip-flop 304C, and the flip-flop 312C stores the output of the signal switching device 311B.

At time tk, in synchronization with signal ϕ5, which is supplied by the timing generator 314, the signal switching device 315 outputs to the FIFO memory 316 a signal value input by the flip-flop 312A. At the same time, at time tk, the FIFO memory 16 is reset in synchronization with signal ϕ5 that is supplied by the timing generator 314.

At time t1, the output of the signal switching device 315 is stored in the FIFO memory 316 in synchronization with signal ϕ8, which is supplied by the timing generator 314. At this time, the signal value output by the flip-flop 312A is stored.

At time tm, in synchronization with signal ϕ6, which is supplied by the timing generator 314, the signal switching device 315 outputs to the FIFO memory 316 a signal value input from the flip-flop 312B. At the same time, at time tm, the contents that were stored at time t1 are output from the FIFO memory 316 in synchronization with signal ϕ9, which is supplied by the timing generator 314.

At time tn, the output of the signal switching device 315 is stored in the FIFO memory 316 in synchronization with signal ϕ8, which is supplied by the timing generator 314. At this time, the signal value output by the flip-flop 312B is stored.

At time to, in synchronization with signal ϕ7, which is supplied by the timing generator 314, the signal switching device 315 outputs to the FIFO memory 316 a signal value input by the flip-flop 312C.

At time tp, the output of the signal switching device 315 is stored in the FIFO memory 316 in synchronization with signal ϕ8, which is supplied by the timing generator 314. At this time, the signal value output from the flip-flop 312C is stored. At the same time, at time tp, the contents that were stored at time tn are output by the FIFO memory 316 in synchronization with signal ϕ9, which is supplied by the timing generator 314.

At time tq, the contents that were stored at time tp are output by the FIFO memory 316 in synchronization with signal ϕ9, which is supplied by the timing generator 314. The output of the FIFO memory 316 is transmitted through the terminal 317A and is displayed on the liquid crystal panel 320.

The above described process is repeated during cycle PT. The relationship between time T and PT is PT=3T.

[Sixth Embodiment]

Figure 12:
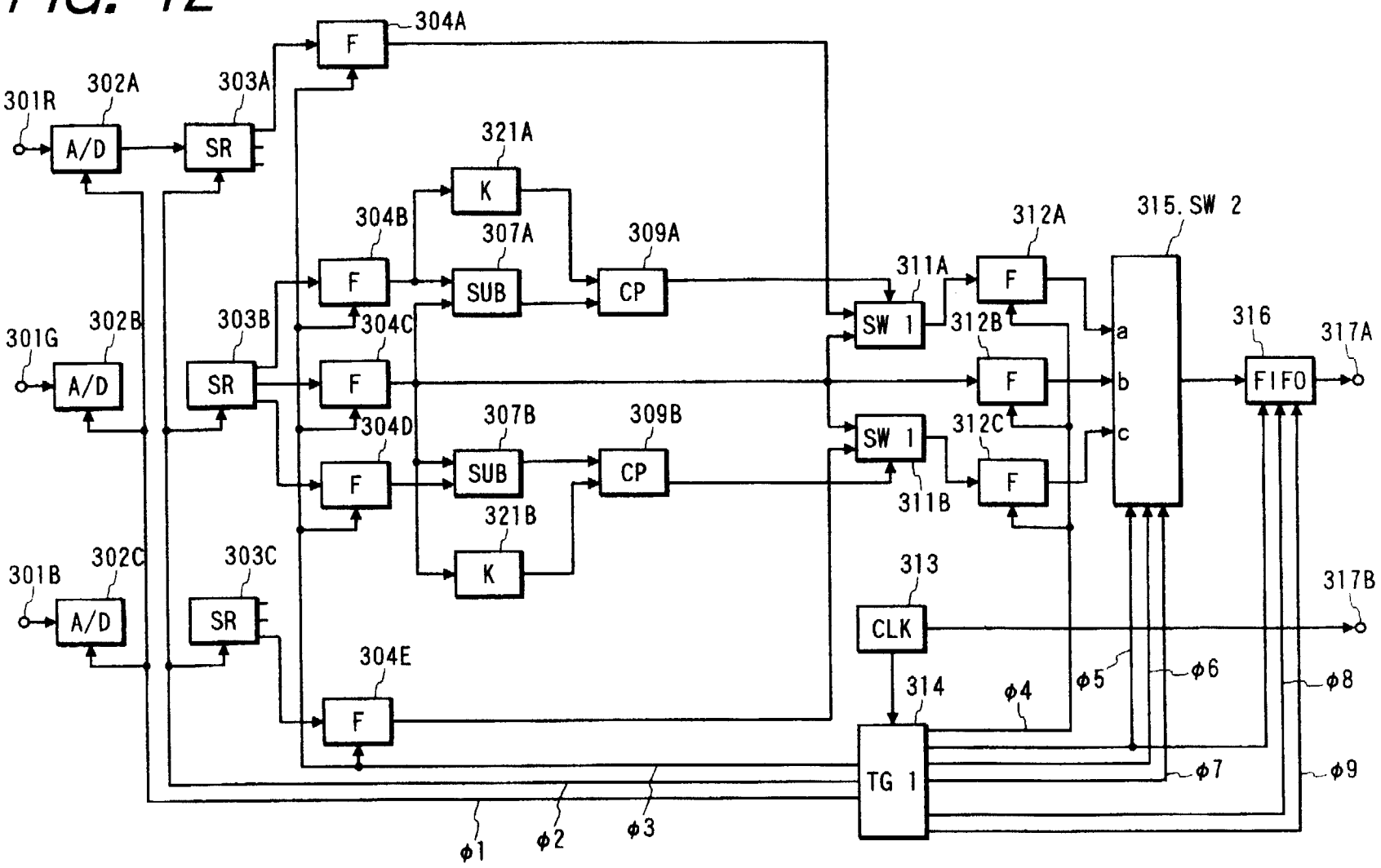
FIG. 12 is a block diagram illustrating a control system for a display device according to a sixth embodiment of the present invention.
Figure 13:
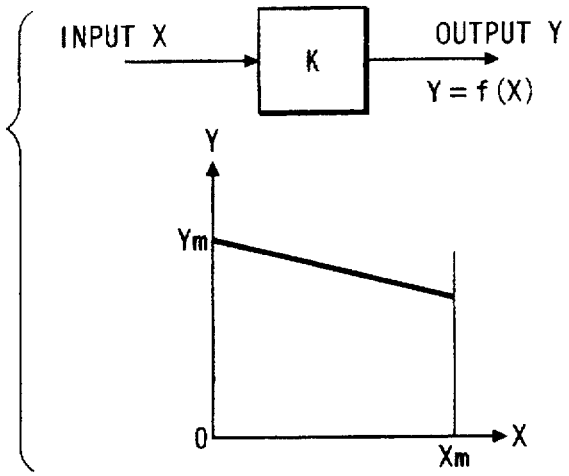
FIG. 13 is a diagram showing an input-output characteristic of a signal processing circuit.

FIG. 12 is a block diagram illustrating the arrangement of a display device according to a sixth embodiment of the present invention. FIG. 13 is a diagram showing an input-output characteristic example for a signal processing circuit in FIG. 12, which will be described later. The same reference numbers as are used in FIG. 9 are also used in FIG. 12 to denote corresponding or identical components. The operating timing is also the same as that in FIG. 11. Signal processors 321A and 321B in FIG. 12 have the relationship Y=f(X) shown in FIG. 13 for input signal X and output signal Y. The input signal X denotes any integer from 0 to Xm, and the output signal Y denotes any integer from 0 to Ym.

First, at time ta, upon receipt of signal ϕ1 from the timing generator 314, the A/D converters 302A, 302B and 302C each sample signals that are input at the respective terminals 301R, 301G and 301B, and hold the resultant signals. These signals that are obtained by sampling correspond to signal values r1, g1 and b1.

At time tb, upon receipt of signal ϕ2 from the timing generator 314, the shift registers 303A, 303B and 303C store and shift signals that are output by the A/D converters 302A, 302B and 302C, respectively.

During the periods between times td and tf, and between tg and ti, the A/D converters 302A, 302B and 302C, and the shift registers 303A, 303B and 303C perform the above described operation. Through this process, the shift register 303A outputs signal values r1, r2 and r3; the shift register 303B outputs signal values g1, g2 and g3; and the shift register 303C outputs signal values b1, b2 and b3.

At time ti, in synchronization with signal ϕ3, which is supplied by the timing generator 314, the flip-flops 304A through 304E hold and output signal values that are output from the shift registers 303A, 303B and 303C. In this embodiment, the flip-flops 304A, 304B, 304C, 304D and 304E hold the respective signal values r1, g1, g2, g3 and b3. The subtracter 307A calculates as an absolute value a difference between signal value g1 of the flip-flop 304B and signal value g2 of the flip-flop 304C, and outputs the absolute value. The subtracter 307B calculates as an absolute value a difference between signal value g2 of the flip-flop 304C and signal value g3 of the flip-flop 304D, and outputs the absolute value. The signal processor 321A receives signal value g1 from the flip-flop 304B and outputs signal value f(g1). The signal processor 321B receives signal value g2from the flip-flop 304C and outputs signal value f(g2). The comparator 309A compares signal value |g1−g2| of the subtracter 307A with signal value f(g1) of the signal processor 321A. When |g1−g2|>f(g1), the comparator 309A outputs a signal of "1". When such a condition is not established, the comparator 309A outputs a signal of "0". The comparator 309B compares signal value |g2−g3| of the subtracter 307B with f(g2) of the signal processor 321B. When |g2−g3|>f(g2), the comparator 309B outputs a signal of "1". When such a condition is not established, the comparator 309B outputs a signal of "0". In consonance with the output of the comparator 309A, the signal switching device 311A selects either signal value r1 of the flip-flop 304A or signal value g2 of the flip-flop 304C, and outputs the selected signal value. In consonance with the output of the comparator 309B, the signal switching device 311B selects either signal value b3 output by the flip-flop 304E or signal value g2 output by the flip-flop 304C, and outputs the selected signal value.

At time tj, the flop-flops 312A, 312B and 312C store input signals in synchronization with signal $\phi 4$ that is supplied from the timing generator 314. The flip-flop 312A stores the output of the signal switching device 311A, the flip-flop 312B stores the output of the flip-flop 304C, and the flip-flop 312C stores the output of the signal switching device 311B.

At time tk, in synchronization with signal $\phi 5$, which is supplied by the timing generator 314, the signal switching device 315 outputs to the FIFO memory 316 a signal value input from the flip-flop 312A. At the same time, at time tk, the FIFO memory 316 is reset in synchronization with signal 45, which is supplied by the timing generator 314.

At time t1, the output of the signal switching device 315 is stored in the FIFO memory 316 in synchronization with signal $\phi 8$, which is supplied by the timing generator 314. At this time, the signal value output by the flip-flop 312A is stored.

At time tm, in synchronization with signal $\phi 6$, which is supplied by the timing generator 314, the signal switching device 315 outputs to the FIFO memory 316 a signal value input by the flip-flop 312B. At the same time, at time tm, the contents that were stored at time t1 are output from the FIFO memory 316 in synchronization with signal $\phi 9$, which is supplied by the timing generator 314.

At time tn, the output of the signal switching device 315 is stored in the FIFO memory 316 in synchronization with signal $\phi 8$, which is supplied from the timing generator 314. At this time, the signal value output by the flip-flop 312B is stored.

At time to, in synchronization with signal $\phi 7$, which is supplied by the timing generator 314, the signal switching device 315 outputs to the FIFO memory 316 a signal value input by the flip-flop 312C.

At time tp, the output of the signal switching device 315 is stored in the FIFO memory 316 in synchronization with signal $\phi 8$, which is supplied by the timing generator 314. At this time, the signal value output from the flip-flop 312C is stored. At the same time, at time tp, the contents that were stored at time tn are output by the FIFO memory 316 in synchronization with signal $\phi 9$, which is supplied by the timing generator 314.

At time tq, the contents that were stored at time tp are output by the FIFO memory 316 in synchronization with signal $\phi 9$, which is supplied by the timing generator 314. The output of the FIFO memory 316 is transmitted through the terminal 317A and is displayed on the liquid crystal panel 320.

The above described process is repeated during cycle PT. The relationship between time T and PT is PT=3T.

As is described above, according to the fifth and the sixth embodiment of the present invention, a display device, comprises: detection means for detecting a change value |A−B| between continuous signal values A and B that are acquired by sampling; first comparison means for comparing the signal value A with predetermined value L0; second comparison means for comparing the change value |A−B| with predetermined value D0; and replacement means for, in consonance with results of comparisons by the first and second comparison means, replacing a signal value, which is to be provided for a pixel of a specific color, with a signal value for another color. Therefore, moiré for an image signal can be reduced and information carried by the image signal can be effectively utilized and displayed.

[Seventh Embodiment]

Figure 14:
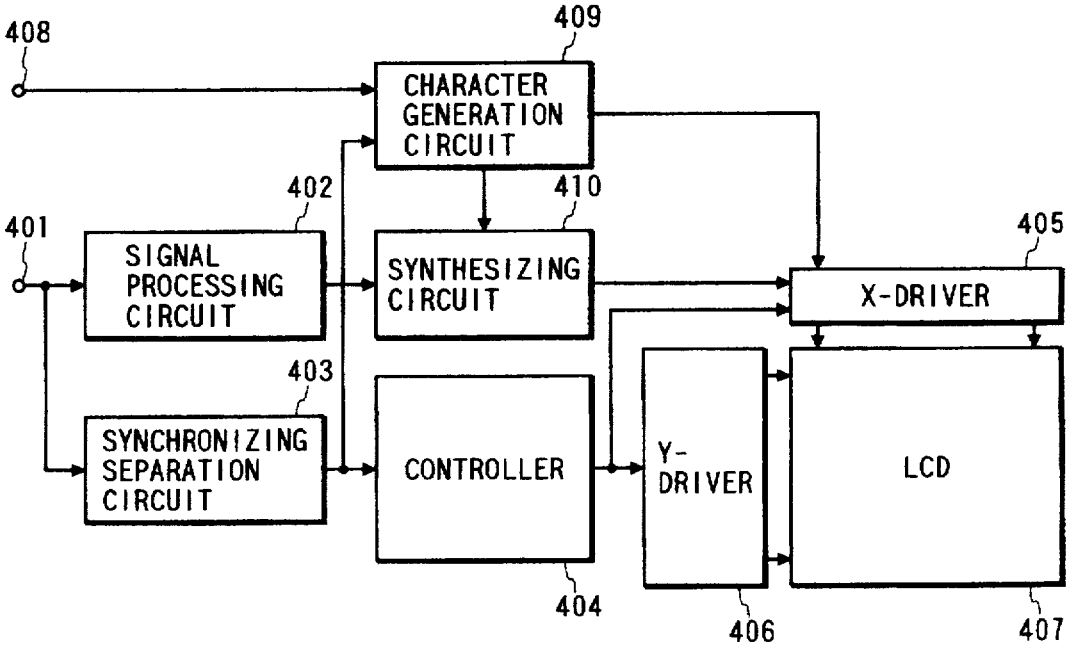
FIG. 14 is a block diagram illustrating a control system for a display device according to a seventh embodiment of the present invention.
Figure 15:
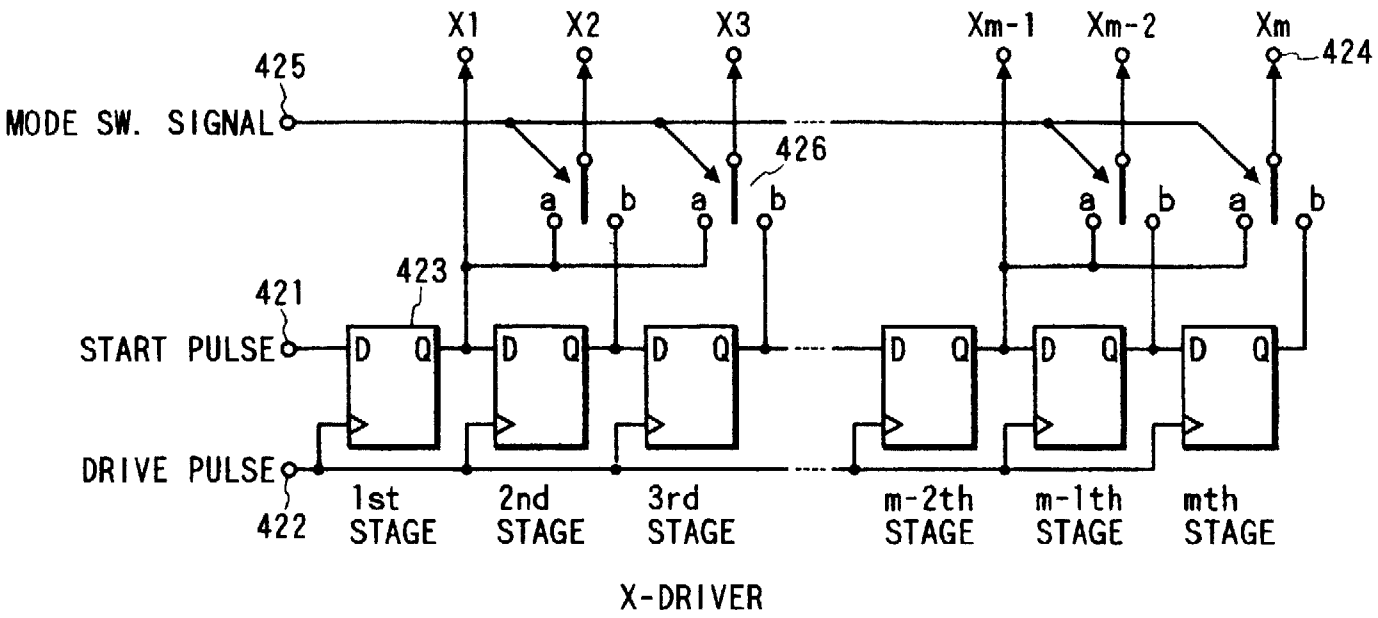
FIG. 15 is a circuit diagram illustrating a driver for the display element that is employed in this invention.

FIG. 14 is a block diagram illustrating a liquid crystal display device according to a seventh embodiment of the present invention. Reference number 401 denotes an input terminal for an image signal; 402, a signal processing circuit; 403, a synchronizing separation circuit; 404, a controller; 405, an X-driver; 406, a Y-driver; 407, an LCD; 408, an input terminal for a control signal for displaying character information; 409, a character generation circuit for generating character information to be displayed based on a control signal that is input at the input terminal 408; and 410, a synthesizing circuit for synthesizing an image signal and character information. The LCD 407 has the arrangement shown in FIG. 31. The X-driver 405 is a shift register having the structure shown in FIG. 15. In FIG. 15, reference number 421 denotes an input terminal for a start pulse; 422, an input terminal for a drive pulse; 423, a D-flip-flop; 424, an output terminal for a drive pulse; 425, an input terminal for a mode select signal; and 426, a switching circuit.

The operation of a liquid crystal display device according to the seventh embodiment of the present invention will now be described while referring to FIGS. 14 and 15. The signal processing circuit 402 performs a predetermined process, such as $\gamma$ compensation or inversion, on an image signal that is input at the input terminal 401 in order to display the image signal. The processed signal is transmitted to the synthesizing circuit 410, and also to the synchronizing separation circuit 403, which separates a synchronization signal from the received signal. The separated synchronization signal is transmitted to the controller 404. In response to the signal, the controller 404 supplies, to the X-driver 405 and the Y-driver 406, a predetermined drive pulse, for driving the LCD 407, that is synchronized with an image signal. Further, a control signal, to display character information together with an image on the LCD 407, is input at the input terminal 408 and is transmitted to the character generation circuit 409. The synchronization signal that was separated by the synchronizing separation circuit 403 is also transmitted to the character generation circuit 409. The character generation circuit 409 then generates characters to be displayed on the LCD 407 in synchronization with an image signal. The image signal output by the signal processing circuit 402 and the output of the character generation circuit 409 are synthesized by the synthesizing circuit 410, and the result is supplied to the X-driver 405. The LCD 407 is driven by an image signal, a signal with which character information is synthesized and a drive pulse, all of which are supplied by the X-driver 405, and by a drive pulse that is supplied by the Y-driver 406, and character information is displayed on the LCD 407 together with an image at the same time.

In addition, the character generation circuit 409 supplies to the input terminal of the X-driver 405 a mode select signal for changing a drive mode. More specifically, the character generation circuit 409 connects the switching circuit 426 across side a for a region in which characters are displayed on a screen, and connects the switching circuit 426 across side b for an region in which characters are not displayed. At this time, m output terminals 424 are connected respectively to switching elements 465R, 465G and 465B of the LCD shown in FIG. 31 via m input terminals 467R, 467G and 467B. When a start pulse is input at the input terminal 421 at the beginning of a horizontal scan period, and a clock that is m times a horizonal frequency is input at the input terminal 422, an m-stage shift register in FIG. 15 is driven by the drive pulse. At this time, for a region in which characters are displayed, upon receipt of a control signal from the character generation circuit 409, the switching circuit 426 is connected across side a. Therefore, the same drive pulse is output to every three of the output terminals 424. The drive pulse is supplied to the gates of the switching elements 465R, 465G and 465B via the input terminals 467R, 467G and 467B, and all the switches are turned on. As a result, sampling is performed at the same time for image signals that are input at input terminals 464R, 464G and 464B, and the resultant signals are supplied to vertical signal lines. For a region in which characters are not displayed, the switching circuit 426 is connected across side b in consonance with a control signal from the character generation circuit 409. Therefore, different drive pulses are sequentially sent from the output terminals 424 to the gates of the switching elements 465R, 465G and 465B, and the switches are turned on. As a result, sampling is performed at different timings for image signals that are input at the input terminals 464R, 464G and 464B, and the resultant signals are supplied to a vertical signal line.

The operation performed hereinafter is common to the above two modes. In the Y-driver in FIG. 33B, when a start pulse is input at the input terminal 431 at the beginning of a vertical scan period, and a horizonal frequency clock is input at the input terminal 432, the shift register having n stages is driven by the drive pulse, and the output pulse of the shift register is output to the output terminals 434. Each of the output terminals 434 is connected to the input terminal 468. When a drive pulse that is output by the Y-driver 406 is supplied to the gate of the switching device 461 across a predetermined horizontal gate line, and each switch is turned on, the liquid crystal cell 462 and the capacitor 463 hold electric charges that correspond to potential differences between signals that are supplied to the input terminals 464, and a voltage that is applied to the common electrode 466. At this time, a predetermined voltage is provided for the common electrode 466. The above process is repeated and an image for one screen can be displayed on the LCD.

In a liquid crystal display device, with this arrangement, which adds character information to an input image for a display, for a region in which characters are not displayed sampling is performed at different phases of image signals relative to R, G and B pixels. For a region in which characters are displayed sampling is performed at the same phase for R, G and B pixels. As a result, the resolution in a region in which an image is displayed is increased, and an occurrence of folded distortion can be prevented when characters are to be displayed.

[Eighth Embodiment]

Figure 16:
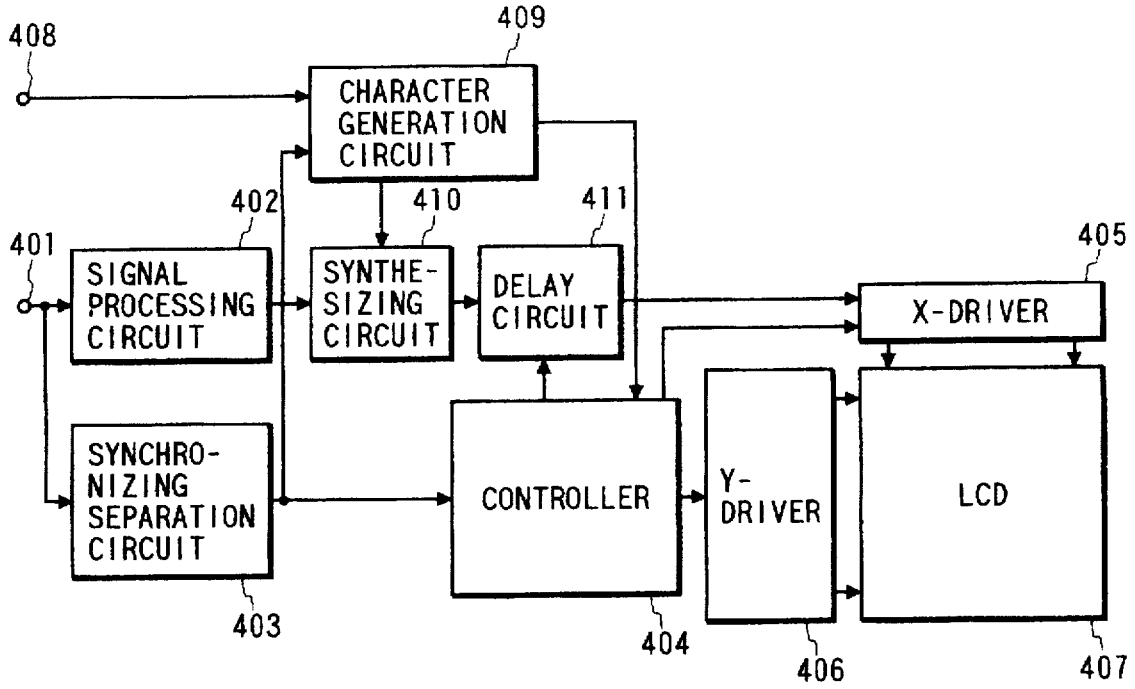
FIG. 16 is a block diagram illustrating a control system for a display device according to an eighth embodiment of the present invention.
Figure 17:
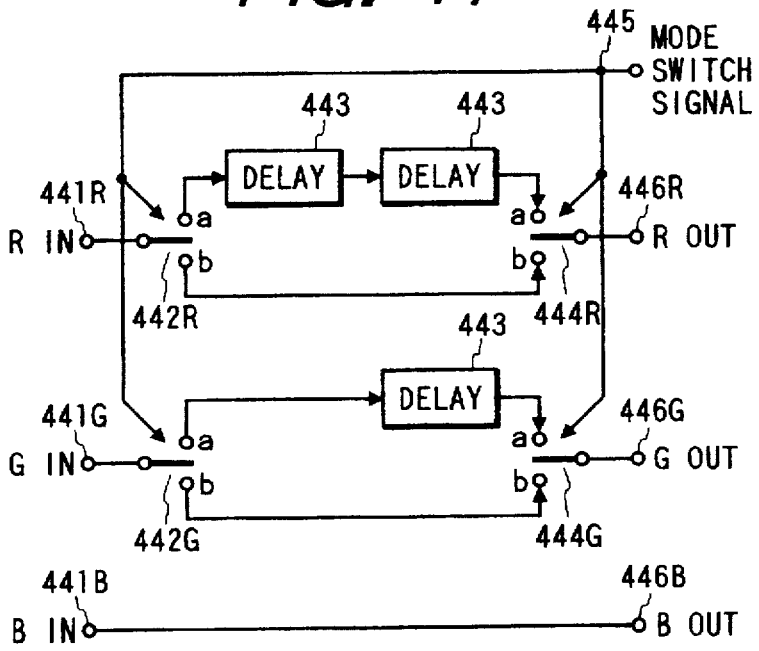
FIG. 17 is a diagram illustrating one arrangement of a delay circuit that is used for the present invention.

FIG. 16 is a block diagram illustrating a liquid crystal display device according to an eighth embodiment of the present invention. Reference number 411 denotes a delay circuit for an image signal. An X-driver 405 is the same as that shown in FIG. 33A. The other components are denoted by using the same reference numbers as are used in FIG. 14. FIG. 17 is a diagram illustrating one example of the delay circuit 411 in FIG. 16. Reference numbers 441R, 441G and 441B denote input terminals for image signals; 442R and 442G, switching circuits; 423, a delay circuit; 444R and 444G, switching circuits; 445, an input terminal for a mode select signal; and 446R, 446G and 446B, output terminals for image signals.

The operation of a liquid crystal display device according to the eighth embodiment of the present invention will now be described while referring to FIGS. 16 and 17. The signal processing circuit 402 performs a predetermined process on an image signal that is input at the input terminal 401 in order to display the image signal. The processed signal is transmitted to the synthesizing circuit 410, and also to the synchronizing separation circuit 403, which separates a synchronization signal from the received signal. The separated synchronization signal is transmitted to the controller 404. In response to the signal, the controller 404 supplies, to the X-driver 405 and the Y-driver 406, a predetermined drive pulse, for driving the LCD 407, that is synchronized with an image signal. Further, a control signal, to display character information together with an image on the LCD 407, is input at the input terminal 408 and is transmitted to the character generation circuit 409. The synchronization signal that was separated by the synchronizing separation circuit 403 is also transmitted to the character generation circuit 409. The character generation circuit 409 then generates characters to be displayed on the LCD 407 in synchronization with an image signal. The image signal output by the signal processing circuit 402 and the output of the character generation circuit 409 are synthesized by the synthesizing circuit 410, and the result is supplied across the delay circuit 411 to the X-driver 405. The LCD 407 is driven by an image signal, a signal with which character information is synthesized and a drive pulse, all of which are supplied by the X-driver 405, and a drive pulse that is supplied by the Y-driver 406, and character information is displayed on the LCD 407 with an image at the same time.

In addition, the character generation circuit 409 supplies to the input terminal of the X-driver 405 a mode select signal for changing a drive mode. More specifically, the character generation circuit 409 connects the switching circuits 442R, 442G, 444R and 444G across side a for a region in which characters are displayed on a screen, and connects the switching circuits 442R, 442G, 444R and 444G across side b for a region in which characters are not displayed. The delay circuit 443 provides a delay that is equivalent to one pixel of the LCD 407. Thus, when the switching circuits 442R, 442G, 444R and 444G are connected across side a, image signal GOUT, which is output at the output terminal 446G, is delayed by one pixel relative to image signal BOUT, which is output at the output terminal 446B, and signal ROUT, which is output at the output terminal 446R, is delayed by two pixels relative to signal BOUT. When the switching circuits 442R, 442G, 444R and 444G are connected across side b, signals that are input at the input terminals 441R, 441G and 441B are sent unchanged to the output terminals 446R, 446G and 446B.

Figure 33A:
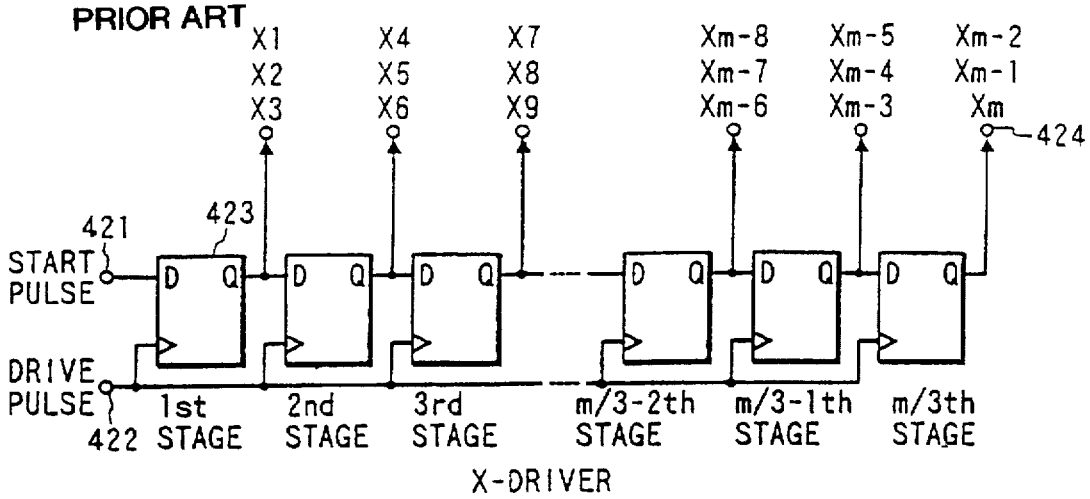
FIG. 33A PRIOR ART
FIGS. 33A and 33B are circuit diagrams illustrating one example of a driver for a display element.

In this embodiment, since the X-driver 405 shown in FIG. 33A is employed, in the LCD 407 sampling is performed for R, G and B pixels at the same phase. However, when an image signal passes through the delay circuit 411, a delay process is performed for the image signal in a region in which characters are not displayed, so that the same effect as is obtained bysampling R, G and B pixels at different phases is acquired. Further, since an image signal for a region in which characters are not displayed does not pass through the delay circuit 411 and thus a delay process is not performed for that signal, sampling is performed for R, G and B pixels at the same phase. The operation hereinafter is the same as that in the seventh embodiment, and no further explanation will be given.

As is described above, for a region of a liquid crystal display device which adds character information to an input image for a display, a conventional x-driver is applied, and as in the seventh embodiment, in which characters are not displayed, sampling for image signals relative to R, G and B pixels is performed at different phases. For a region in which characters are displayed, sampling is performed at the same phase for R, G and B pixels. As a result, the resolution in a region in which an image is displayed is increased, and an occurrence of folded distortion can be prevented when characters are to be displayed.

Figure 18:
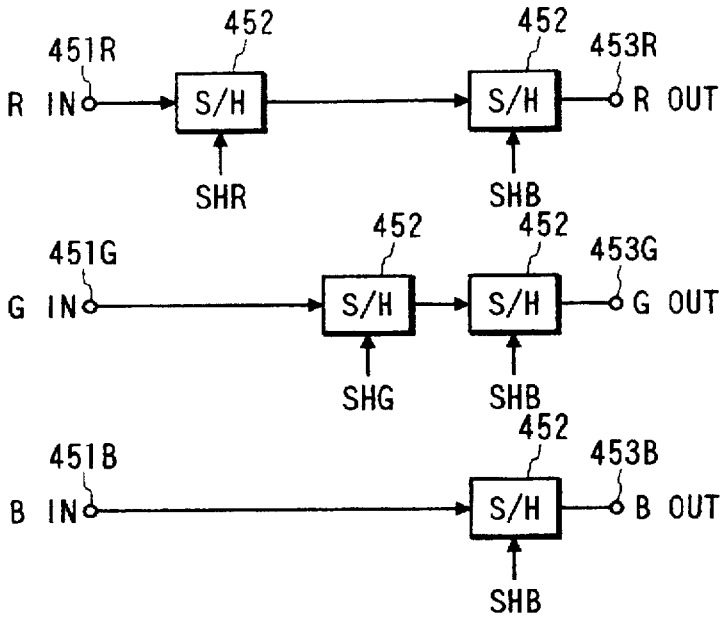
FIG. 18 is a diagram illustrating another arrangement for the delay circuit that is used for the present invention.
Figure 19A:
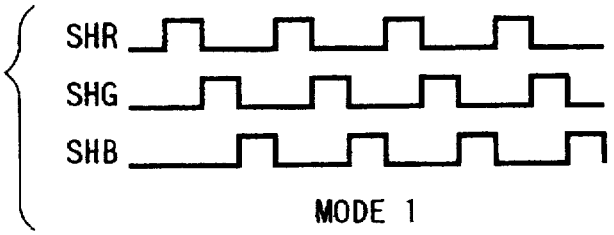
FIGS. 19A and 19B are diagrams showing a sample hold pulse for the delay circuit shown in FIG. 18.
Figure 19B:
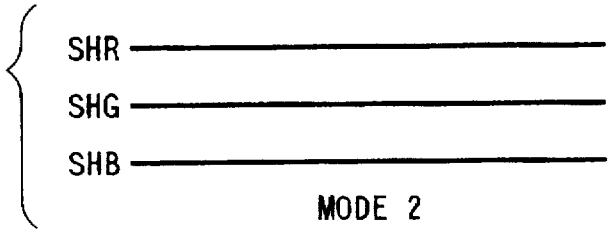

As a modification of this embodiment, the delay circuit 411 in FIG. 16 may have the arrangement shown in FIG. 18. Reference numbers 451R, 451G and 451B denote input terminals for image signals; 452, a sample-hold circuit; and 453R, 453G and 453B, output terminals for image signals. For a region in which characters are not displayed, the controller 404 transmits to the delay circuit 411 sample-hold pulses shown in FIG. 19A. The phase of each pulse is shifted by one pixel of the LCD. Thus, in the delay circuit shown in FIG. 17, image signal GOUT, which is output at the output terminal 453G, is delayed by one pixel relative to signal BOUT, which is output at the output terminal 453B, and signal ROUT, which is output at the output terminal 453R, is delayed by two pixels. For a region in which characters are displayed, pulses shown in FIG. 19B are supplied. By making the sample-hold circuits 452 pass signals through, image signals that are input at the input terminals 451R, 451G and 451B are output unchanged to the output terminals 453R, 453G and 453B.

With this arrangement, the same effect as is obtained when the delay circuit in FIG. 17 is employed is acquired. Further, since the delay circuit is designed with sample-hold circuits, this arrangement can easily cope with a change in the number of pixels in the LCD.

[Ninth Embodiment]

Figure 20:
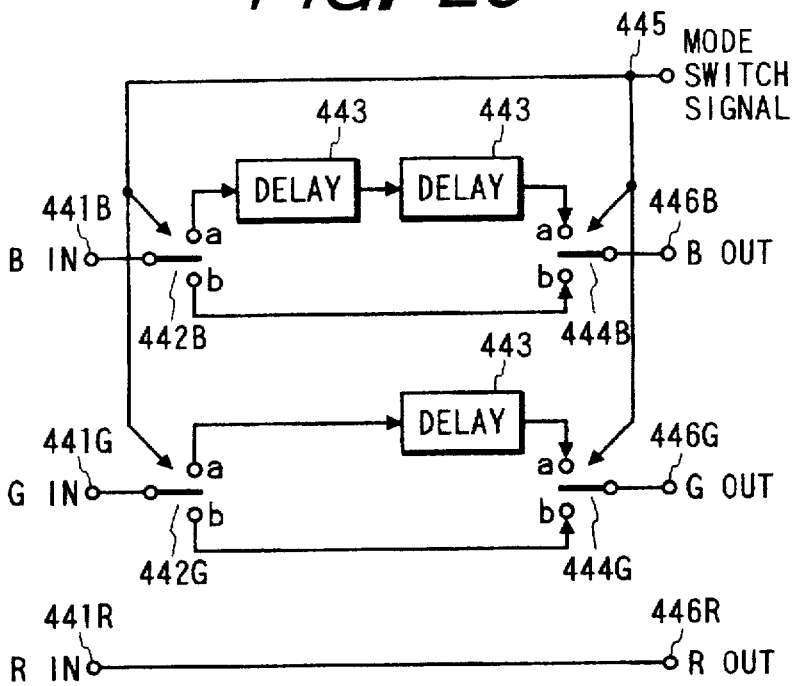
FIG. 20 is a diagram illustrating the arrangement of a delay circuit that is used for a ninth embodiment of the present invention.
Figure 34:
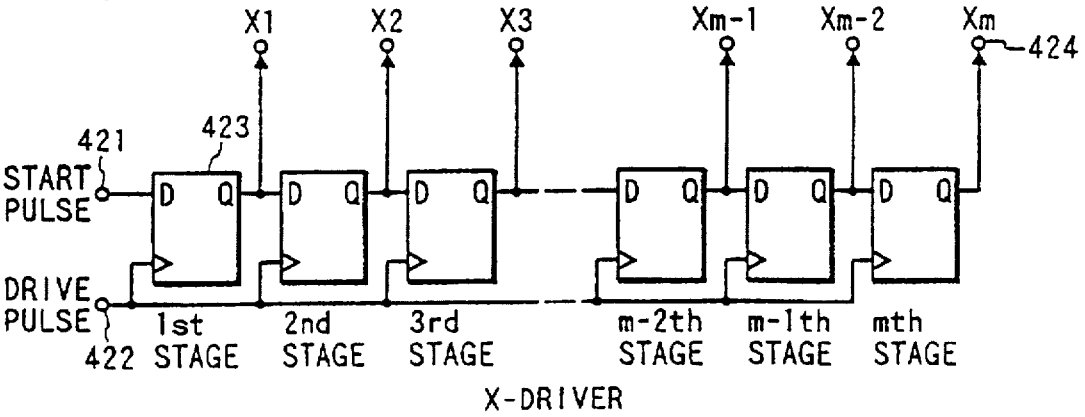
FIG. 34 PRIOR ART
FIG. 34 is a circuit diagram illustrating another example of a driver for a display element.

The arrangement for a liquid crystal display device according to a ninth embodiment of the present invention is the same as that shown in FIG. 16 for the eighth embodiment, except that the X-driver 405 in FIG. 34 and the delay circuit 411 in FIG. 20 are employed. The operation for the ninth embodiment is also the same as that for the eighth embodiment, except for the control of these components, and no explanation for it will be given. The same reference numbers as are used in FIG. 17 are also used in FIG. 20 to denote corresponding or identical components. For a region in which characters are displayed, switching circuits 442B, 442G, 444B and 444G are connected across side a in consonance with a control signal from a character generation circuit 409. For a region in which characters are not displayed, these switching circuits are connected across side b. Since the X-driver 405 is designed as is shown in FIG. 34, an LCD 407 performs sampling for R, G and B pixels at different timings. Since a delay process is not performed for an image signal for a region in which characters are not displayed, sampling is performed for R, G and B pixels at different phases. Since an image signal for a region in which characters are displayed passes through the delay circuit 411 and thus a delay process is performed for that signal, the same effect as is obtained by sampling the three pixels at the same phase can be acquired.

In this manner, the effect obtained in the eighth embodiment can also be acquired in this embodiment.

Figure 21:
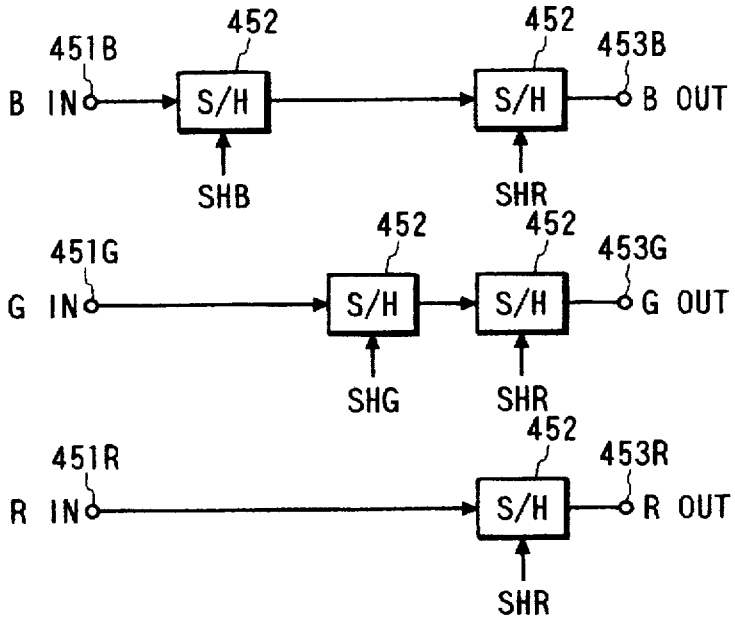
FIG. 21 is a diagram illustrating an additional arrangement for the delay circuit that is used for the present invention.
Figure 22A:
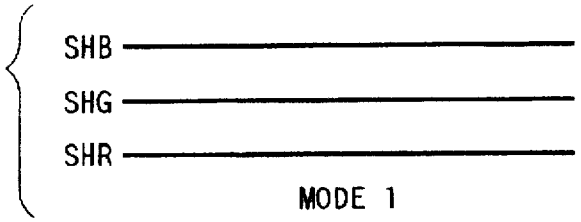
FIGS. 22A and 22B are diagrams showing a sample hold pulse for the delay circuit shown in FIG. 21.
Figure 22B:
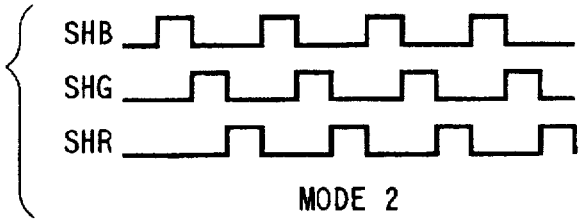

As well as in the eighth embodiment, the delay circuit 411 shown in FIG. 21 may be employed, and sample-hold pulses shown in FIGS. 22A and 22B may be supplied. In FIG. 21, the same reference numbers as are used in FIG. 18 are also used to denote corresponding or identical components. In addition, sample-hold pulses in FIG. 22A can be supplied for a region in which characters are not displayed, and pulses in FIG. 22B can be supplied for a region in which characters are displayed.

[Tenth Embodiment]

Figure 23:
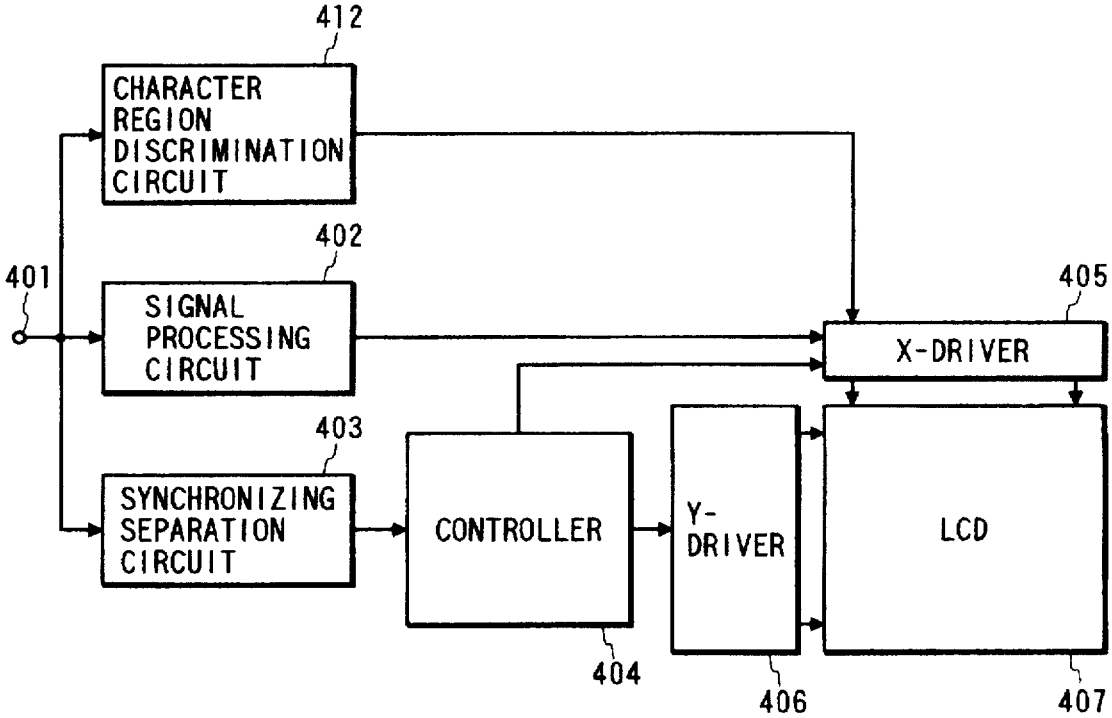
FIG. 23 is a block diagram illustrating a control system for a display device according to a tenth embodiment of the present invention.

FIG. 23 is a block diagram illustrating a liquid crystal display device according to a tenth embodiment of the present invention. A character region discrimination circuit 412 identifies a character region for an input image signal. The other components are the same as those shown in FIG. 14.

The operation of the liquid crystal display device according to the tenth embodiment of the present invention will now be described while referring to FIG. 23. An image signal that is input at an input terminal 401 is transmitted to a signal processing circuit 402, a synchronizing separation circuit 403, and a character region discrimination circuit 412. The signal processing circuit 402 performs a predetermined process on the image signal that is to be displayed on an LCD 407, and transmits the resultant image signal to an X-driver 405. The synchronizing separation circuit 403 separates a synchronization signal from the image signal, and transmits the synchronization signal to a controller 404. Upon receipt of this signal, the controller 404 supplies predetermined drive pulses to an X-driver 405 and a Y-driver 406 to drive the LCD 407 in synchronization with the image signal. The character region discrimination circuit 412 identifies, from an input image signal, a region in which characters are included and a region in which characters are not included, and supplies a control signal for drive mode switching to the X-driver 405. The LCD 407 is driven by an image signal and a drive pulse that is supplied by the X-driver 405 and by a drive pulse that is supplied by the Y-driver 406, and displays character information with an image on a screen.

In this embodiment, the X-driver 405 is the same as that shown in FIG. 15. When, as well as in the seventh embodiment, the character region discrimination circuit 412 identifies a region in which characters are included, the character region discrimination circuit 412 outputs a control signal, and the switching circuit 426 is connected across side a. When the circuit 412 ascertains that no characters are included in a region, the switching circuit 426 is connected across side b. Therefore, as in the seventh embodiment, when an input image signal is to be displayed on the LCD 407, sampling of R, G and B pixels is performed at different phases for a region in which no characters are included, while sampling of R, G and B pixels is performed at the same phase for a region in which characters are included. The operation hereinafter is the same as that in the seventh embodiment, and no further explanation will be given.

As is described above, for a region, of a liquid crystal display device that displays an input image in which character information is included, in which characters are not displayed, sampling of image signals relative to R, G and B pixels is performed at different phases, and for a region in which characters are displayed sampling of R, G and B pixels is performed at the same phase. As a result, the resolution in a region in which an image is displayed is increased, and an occurrence of folded distortion can be prevented when characters are to be displayed.

[Eleventh Embodiment]

Figure 24:
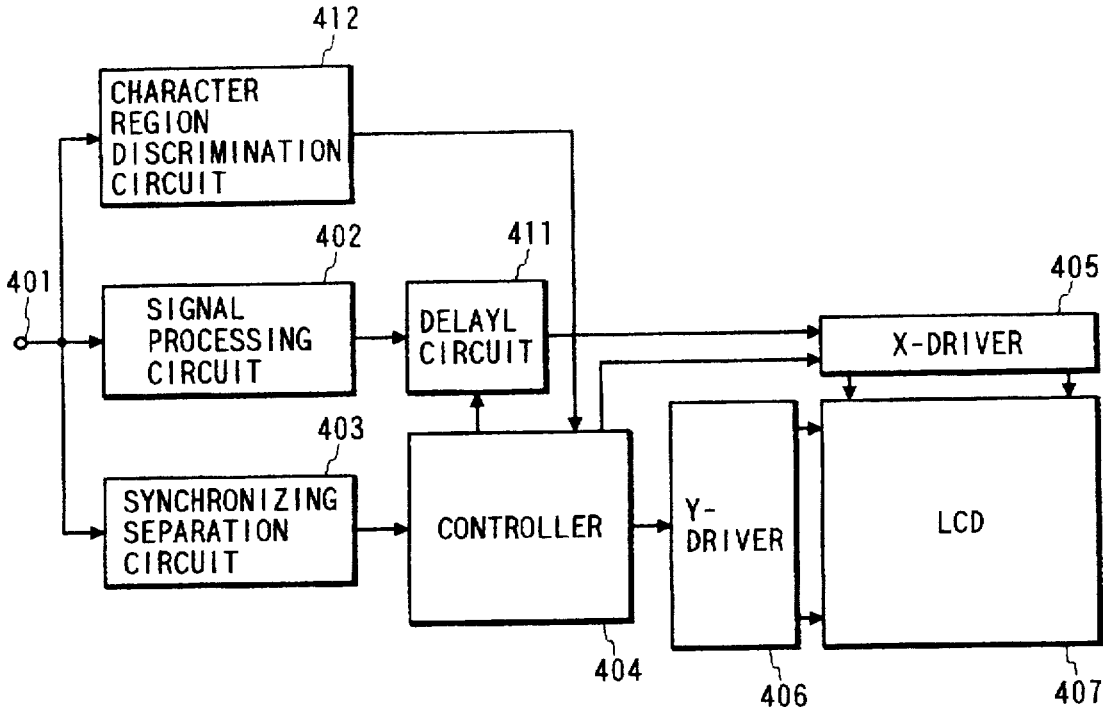
FIG. 24 is a block diagram illustrating a control system for a display device according to an eleventh embodiment of the present invention.

FIG. 24 is a block diagram illustrating a liquid crystal display device according to an eleventh embodiment of the present invention. In this embodiment, the X-driver 405 shown in FIG. 33A is employed, and the delay circuit 411 shown in FIG. 17 or FIG. 18 is employed. The delay circuit 411 is operated by using a control signal that is transmitted from a character region discrimination circuit 412 through a controller 404, and that controls an image signal display. The control method is the same as that described in the eighth embodiment; for a region in which characters are not displayed, a delay process is performed for an image signal, and for a region in which characters are displayed, the delay process is not performed.

With this arrangement, while a conventional X-driver is applied, the same effect as is acquired in the tenth embodiment can be obtained.

[Twelfth Embodiment]

The arrangement of a liquid crystal display device according to a twelfth embodiment of the present invention is the same as that for the eleventh embodiment in FIG. 24. In this embodiment, the X-driver 405 shown in FIG. 34 is employed, and the delay circuit 411 shown in FIG. 20 or FIG. 21 is employed. The delay circuit 411 is operated by using a control signal that is transmitted from a character region discrimination circuit 412 through a controller 404, and that controls an image signal delay. The control method is the same as that described in the ninth embodiment; for a region in which characters are not displayed, a delay process is not performed for an image signal, and for a region in which characters are displayed, the delay process is performed.

With this arrangement, the same effect as is acquired in the eleventh embodiment can be obtained.

As is described above, according to the seventh through the twelfth embodiments of the present invention, for a region, of a liquid crystal display device that adds character information to an input image signal for a display, in which characters are not displayed sampling of image signals relative to R, G and B pixels is performed at different phases, and for a region in which characters are displayed sampling of R, G and B pixels is performed at the same phase. As a result, the resolution of a region in which an image is displayed is increased, and an occurrence of folded distortion can be prevented when characters are to be displayed.

In addition, when delay means is provided for a display device, which adds character information to an input image signal for a display, a conventional X-driver can be applied without any modification.

[Thirteenth Embodiment]

Figure 31:
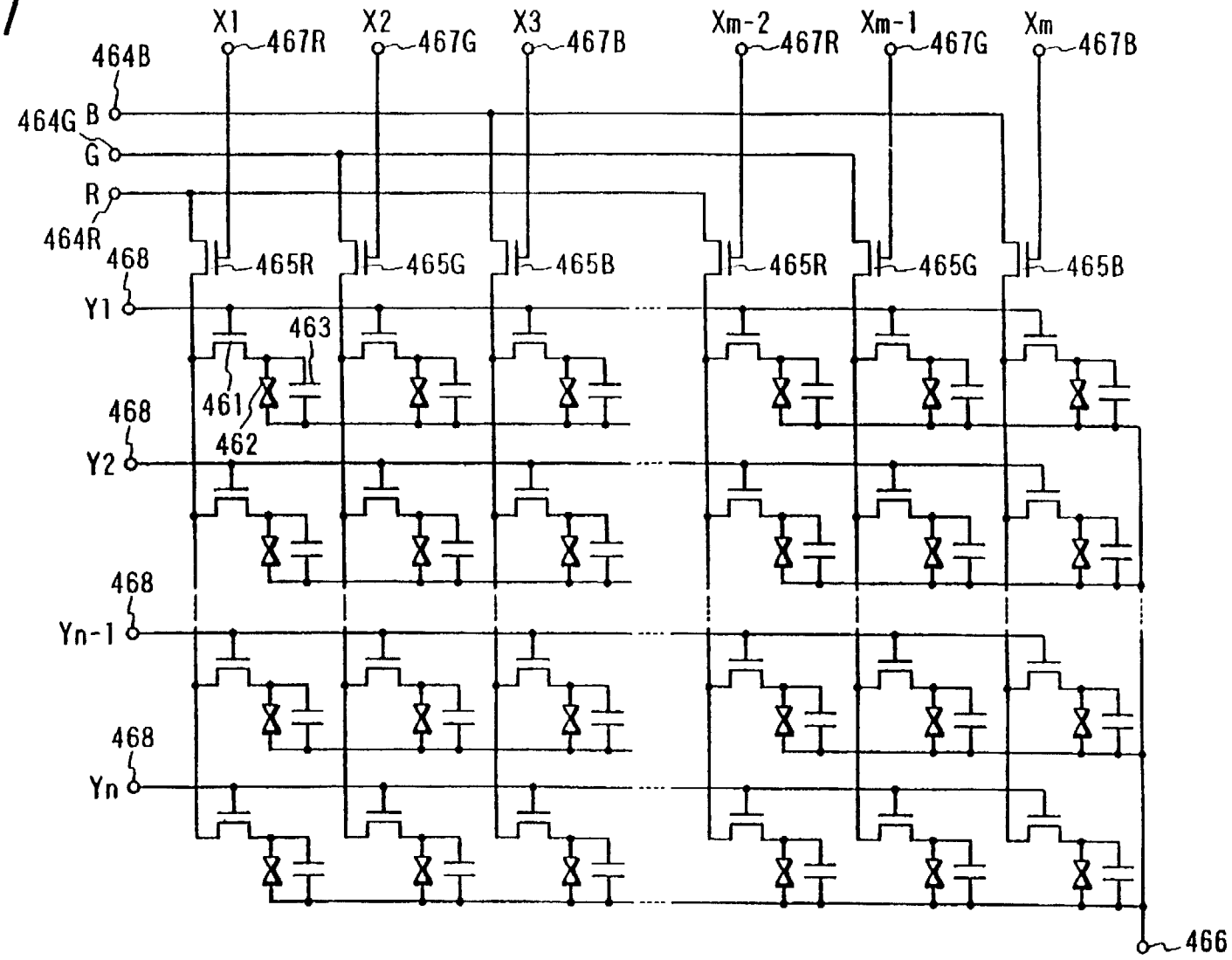
FIG. 31 PRIOR ART
FIG. 31 is a circuit diagram illustrating a liquid crystal element.
Figure 33B:
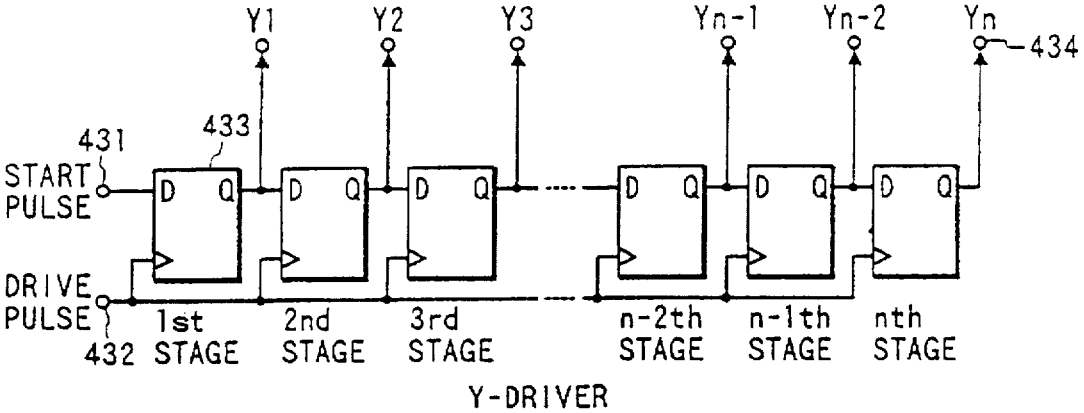
FIG. 33B PRIOR ART

The arrangement of a liquid crystal display device according to a thirteenth embodiment of the present invention is the same as is shown in FIG. 23. In FIG. 23, reference number 401 denotes an input terminal for an image signal; 402, a signal processing circuit; 403, a synchronizing separation circuit; 404, a controller; 405, an X-driver; 406, a Y-driver; 407, an LCD; and 412, a character region discrimination circuit for identifying a character region for an input image signal. The LCD 407, as well as prior art, has the arrangement as is shown in FIG. 31. The X-driver 405 is a shift register with the structure shown in FIG. 15. Reference number 421 denotes an input terminal for a start pulse; 422, an input terminal for a drive pulse; 423, a D-flip-flop; 424, an output terminal for a drive pulse; 425, an input terminal for a mode select signal; and 426, a switching circuit. A Y-driver 406 also has the same structure as prior art and is shown in FIG. 33B.

The operation of a liquid crystal display device according to the thirteenth embodiment of the present invention will now be described while referring to FIGS. 23 and 15. An image signal that is input at the input terminal 401 is transmitted to the signal processing circuit 402, the synchronizing separation circuit 403 and the character region discrimination circuit 412. The signal processing circuit 402 performs a predetermined process, such as γ compensation or inversion, on the image signal in order to display the image signal. The processed signal is transmitted to the X-driver 405. The synchronizing separation circuit 403 separates a synchronization signal from the received signal and the separated synchronization signal is transmitted to the controller 404. In response to the signal, the controller 404 supplies, to the X-driver 405 and the Y-driver 406, a predetermined drive pulse, for driving the LCD 407, that is synchronized with an image signal. Further, the character region discrimination circuit 412 identifies, from the input image signal, a region in which characters are included and a region in which characters are not included, and then supplies a control signal for drive mode switching to the X-driver 405. The LCD 407 is driven by an image signal and a drive pulse that is supplied by the Y-driver 406, and character information and an image are displayed on the LCD 407 at the same time.

The character region discrimination circuit 412 connects the switching circuit 426 across side a for a region in which characters are displayed on a screen, and connects the switching circuit 426 across side b for a region in which characters are not displayed. At this time, m output terminals 424 are connected respectively to switching elements 465R, 465G and 465B of the LCD 407 via m input terminals 467R, 467G and 467B. When a start pulse is input from the input terminal 421 at the beginning of a horizontal scan period, and a clock that is m times a horizonal frequency is input from the input terminal 422, an m-stage shift register in FIG. 15 is driven by the drive pulse. At this time, for a region in which characters are displayed, upon receipt of a control signal from the character region discrimination circuit 412 the switching circuit 426 is connected across side a. Therefore, the same drive pulse is output to every three output terminals 424. The drive pulse is supplied to the gates of the switching elements 465R, 465G and 465B via the input terminals 467R, 467G and 467B, and all the switches are turned on. As a result, sampling is performed at the same time for image signals that are input from input terminals 464R, 464G and 464B, and the resultant signals are supplied to vertical signal lines. For a region in which characters are not displayed, the switching circuit 426 is connected across side b in consonance with a control signal from the character region discrimination circuit 412. Therefore, different drive pulses are sequentially sent from the output terminals 424 to the gates of the switching elements 465R, 465G and 465B, and the switches are turned on. As a result, sampling of image signals that are input at the input terminals 464R, 464G and 464B is performed at different timings, and the resultant signals are supplied to a vertical signal line.

The operation performed hereinafter is common to the above two modes. When a start pulse is input at the input terminal 431 at the beginning of a vertical scan period, and a horizonal frequency clock is input at the input terminal 432, the shift register in the Y-driver having n stages is driven by the drive pulse, and the output pulse of the shift register is output to the output terminals 434. Each of the output terminals 434 is connected to the input terminal 468. When a drive pulse that is output by the Y-driver 406 is supplied to the gate of the switching device 461 across a predetermined horizontal gate line, and each switch is turned on, the liquid crystal cell 462 and the capacitor 463 hold electric charges that correspond to potential differences between signals that are supplied to the input terminals 464 and a voltage that is applied to the common electrode 466. At this time, a predetermined voltage is provided for the common electrode 466. The above process is repeated, and an image for one screen can be displayed on the LCD.

Figure 25:
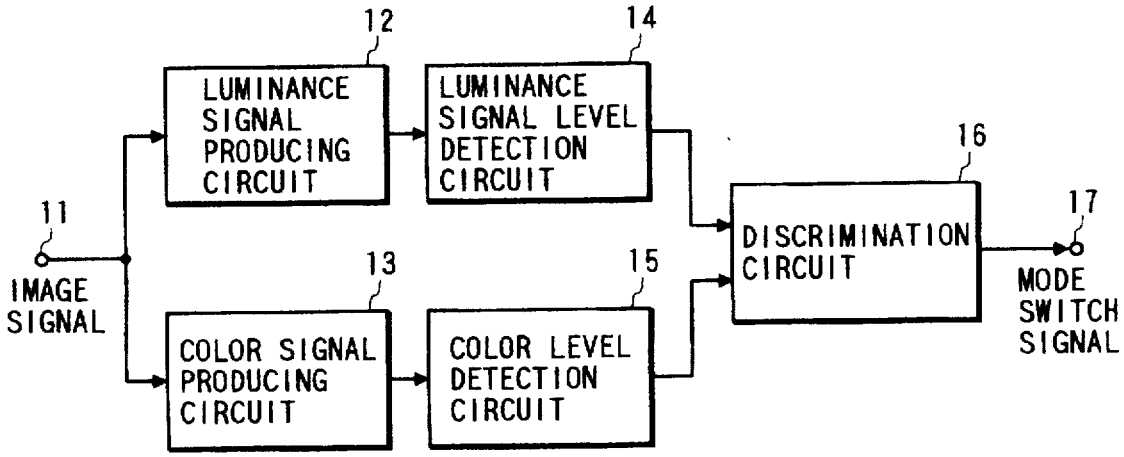
FIG. 25 is a diagram illustrating the arrangement of a character region discrimination circuit that is employed for the display device of the present invention.

FIG. 25 is a specific diagram illustrating the arrangement of the character region discrimination circuit 412 in FIG. 23 according to the thirteenth embodiment of the present invention. Reference number 411 denotes an input terminal for a video signal; 412, a luminance signal producing circuit; 413, a color signal producing circuit from an input image signal that produces a color signal; 414, a luminance signal level detection circuit; 415, a color level detection circuit; 416, a discrimination circuit for determining whether a region is a region in which characters are displayed or a region in which characters are not displayed; and 417, an output terminal for a mode select signal.

The operation of the character region discrimination circuit in this embodiment will now be described. An image signal that is supplied to the input terminal 401 in FIG. 23, i.e., a signal that is to be transmitted to the LCD 407 via the signal processing circuit 402, is input at the input terminal 411. The image signal that was input at the input terminal 411 is transmitted to the luminance signal producing circuit 412 and also to the color signal producing circuit 413. The luminance signal producing circuit 412 produces a luminance signal from an image signal. In other words, when an input image signal is a complex image signal, Y/C separation is performed to produce a luminance signal. When an input image signal is an RGB signal, a predetermined calculation (Y=0.3R+0.59G+0.11B) is performed to produce a luminance signal. The color signal producing circuit 413 produces a color signal from an input image signal. When an input image signal is a complex image signal, a produced color signal may be a chroma signal obtained by Y/C separation, or a color difference signal obtained by demodulating the chroma signal. When an input signal is an RGB signal, a predetermined calculation is performed to produce a color difference signal. A luminance signal that is produced by the luminance signal producing circuit 412, and a color signal that is produced by the color signal producing circuit 413 are input to the luminance signal level detection circuit 414 and the color signal level detection circuit 415, respectively. The signal levels of the individual signals are determined and are sent to the discrimination circuit 416. The discrimination circuit 416 determines whether or not a received signal indicates a character, and transmits the result as a mode select signal to the output terminal 417. The mode select signal that is output at the output terminal 417 is supplied to the X-driver 405 to control it, as is described above. More specifically, the discrimination circuit 416 outputs a control signal, so that, for a region in which characters are displayed on a screen, the switching circuit 426 is connected across side a, and for a region in which characters are not displayed on a screen, the switching circuit 426 is connected across side b.

A specific determination method performed by the discrimination circuit 416 in this embodiment will now be explained. When the luminance signal level detection circuit 414 determines that the level of a luminance signal is higher than a predetermined value, and at that time the color level detection circuit 415 does not detect a color signal, i.e., when an input image is monotone, or when the color signal level detection circuit 415 determines the color signal level is lower than a predetermined value, i.e., when an input image is nearly monotone, the discrimination circuit 416 ascertains that a region of a display image that is currently input is a region in which characters are included, and outputs an appropriate mode select signal. The discrimination circuit 416 ascertains that the other regions are those in which characters are not included, and outputs a corresponding mode select signal. As is described above, the discrimination circuit in this embodiment ascertains that a region of a display image for which a color signal level is lower than a predetermined value is a region in which characters are displayed, and that a region for which the color signal level is greater than a predetermined value is a region in which characters are not displayed. According to the results of the determination, the discrimination circuit 416 outputs a select signal for controlling a phase for sampling before an image is to be displayed.

With this arrangement, for a region, of a liquid crystal display device that displays an input image in which character information is included, in which characters are not displayed, sampling of image signals relative to R, G and B pixels is performed at different phases, and for a region in which characters are displayed, sampling is performed at the same phase for R, G and B pixels. As a result, the resolution in a region in which an image is displayed is increased, and an occurrence of folded distortion can be prevented when characters are to be displayed.

[Fourteenth Embodiment]

Figure 26:
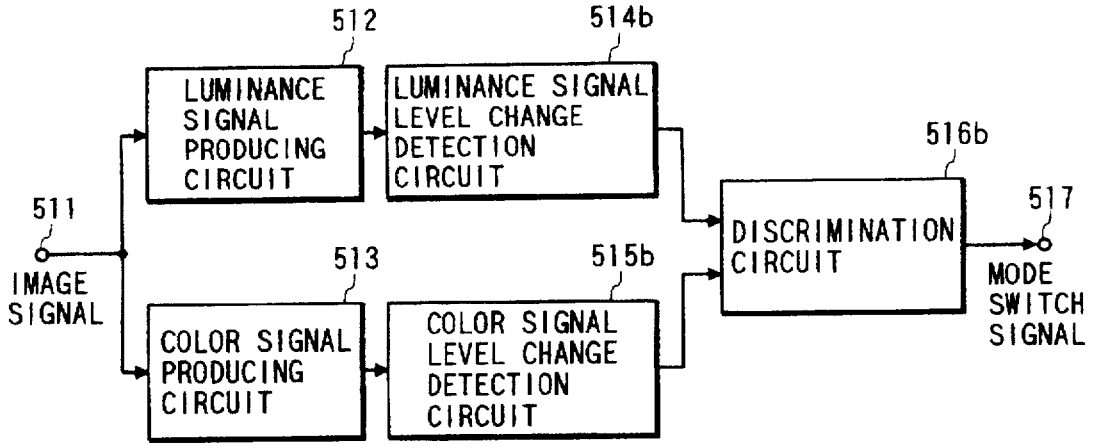
FIG. 26 is a diagram illustrating the arrangement of a character region discrimination circuit that is employed for a display device according to a fourteenth embodiment of the present invention.

FIG. 26 is a diagram illustrating the arrangement of a character region discrimination circuit that is employed for a liquid crystal display device according to a fourteenth embodiment of the present invention. The general arrangement of the display device is the same as that in the thirteenth embodiment, and as it was previously shown in FIG. 23, no explanation will be given. In FIG. 26, reference number **514*b* denotes a luminance signal level change detection circuit; 515*b*, a color signal level change detection circuit; and 516*b***, a discrimination circuit for determining a region in which characters are to be displayed or a region in which characters are not to be displayed.

Figure 27:
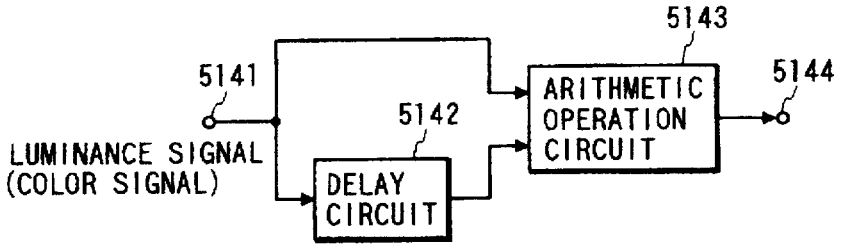
FIG. 27 is a circuit diagram illustrating a color signal level change detection circuit that is employed for the present invention.

The operation of the character region discrimination circuit and the determination method in this embodiment will be explained. An image signal that is input at an input terminal 511 is transmitted to a luminance signal producing circuit 512 and to a color signal producing circuit 513, which then output a luminance signal and a color signal, respectively. These signals are supplied to the luminance signal level change detection circuit **514*b* and the color signal level change detection circuit 515*b*. The luminance signal level change detection circuit 514*b* detects a change in the level of a received luminance signal, and transmits the result of the detection to the discrimination circuit 516*b*. In the same manner, the color signal level change detection circuit 515*b* detects a change in the level of an input color signal, and transmits the result of the detection to the discrimination circuit 516*b*. Specific arrangements of the luminance signal level change detection circuit 514*b* and the color signal level change detection circuit 515*b* are shown in FIG. 27. As is shown in FIG. 27, a luminance signal or a color signal that is input at the input terminal 5141 is sent to an arithmetic operation circuit 5143 together with a signal that is delayed a predetermined time by a delay circuit 5142. The arithmetic operation circuit outputs the result of the arithmetic operation at the output terminal 5144. In other words, a difference at a given time interval between the signal levels of input luminance signal and the input color signal is output as the result of the detection. The discrimination circuit 516*b* employs the received detection signals to determine a region in which characters are displayed or a region in which characters are not displayed, and outputs the result of the determination to the output terminal 517. At this time, when a difference in the level of a luminance signal, which is supplied by the luminance signal level change detection circuit 514*b*, is greater than a predetermined value, and when a difference in the level of a color signal, which is supplied by the color signal level change detection circuit 515*b*, is smaller than a predetermined value, the discrimination circuit 516b determines that the target portion is a region in which characters are to be displayed, and outputs a corresponding mode select signal to the output terminal 517. In the other case, the discrimination circuit 516b determines that a portion is a region in which characters are not to be displayed, and outputs a corresponding mode select signal to the output terminal 517. As is described above, the discrimination circuit in this embodiment ascertains that a portion of a display image, for which a change in a luminance signal level is greater than a predetermined value and a change in a color signal level is smaller than a predetermined value, is a region in which characters are displayed, and that the other region is a region in which characters are not displayed. According to the results of the determination, the discrimination circuit 416** outputs a select signal for controlling a phase for sampling before an image is to be displayed.

Figure 28:
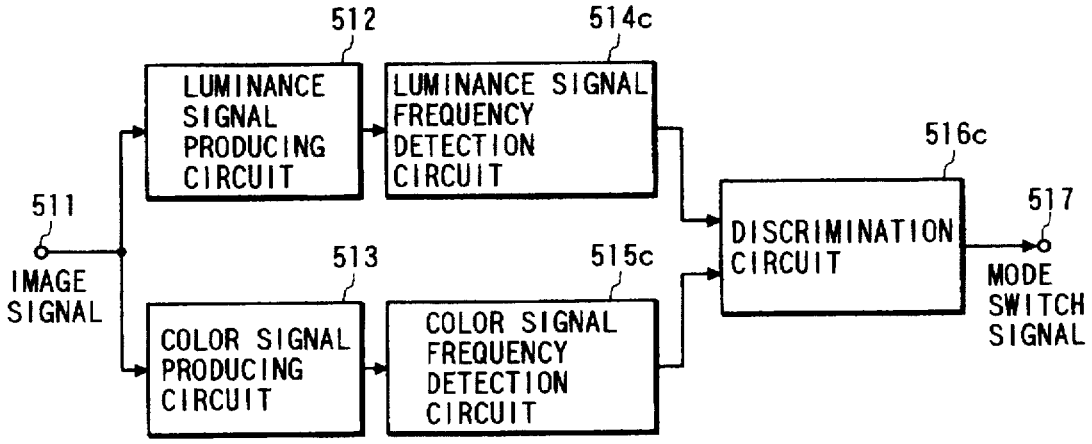
FIG. 28 is a circuit diagram illustrating a frequency detection circuit that is employed for the present invention.
Figure 29:
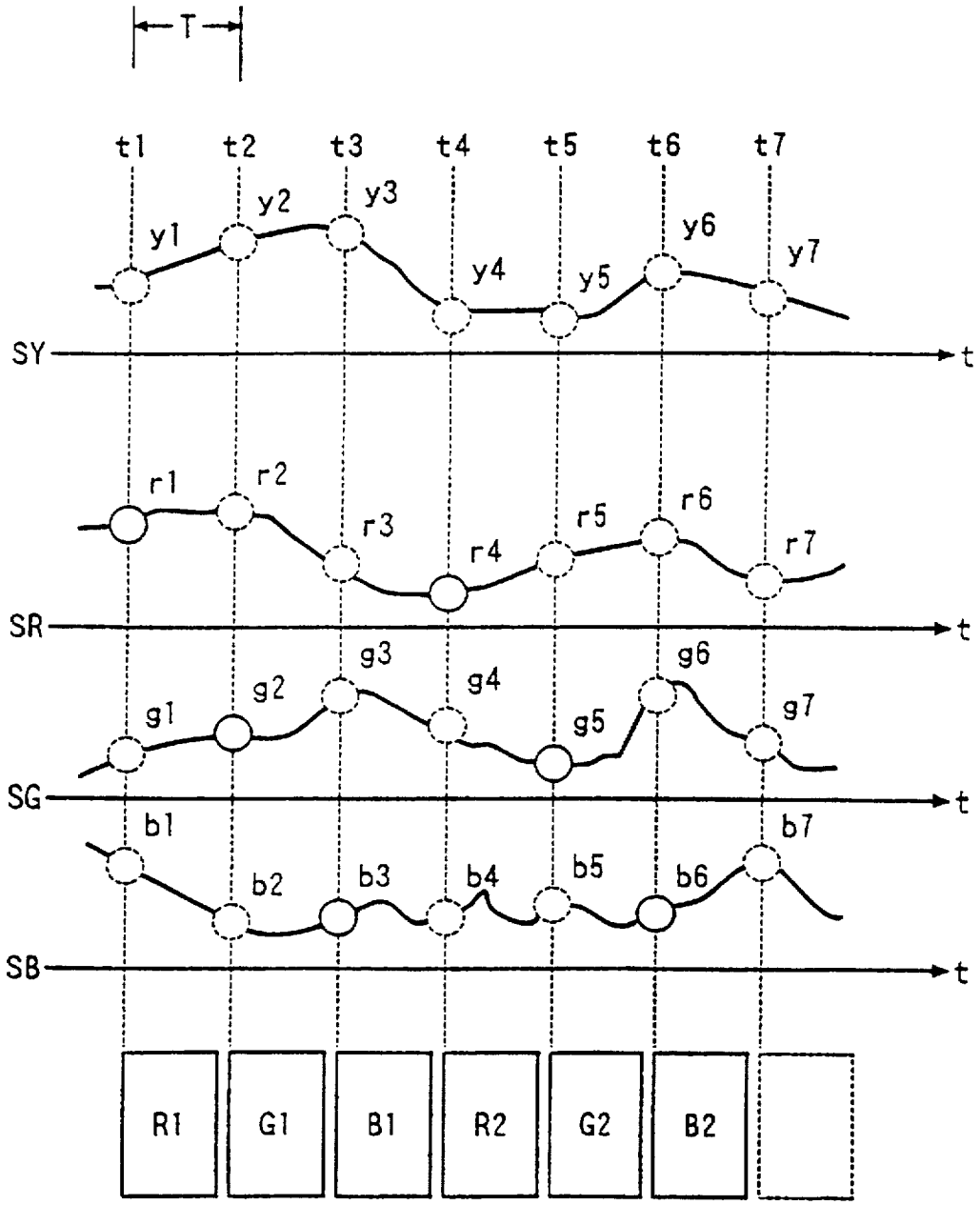
FIG. 29 PRIOR ART
FIG. 29 is a specific diagram for explaining the relationship between a sampling timing for input image signals and for display pixels.
Figure 30:
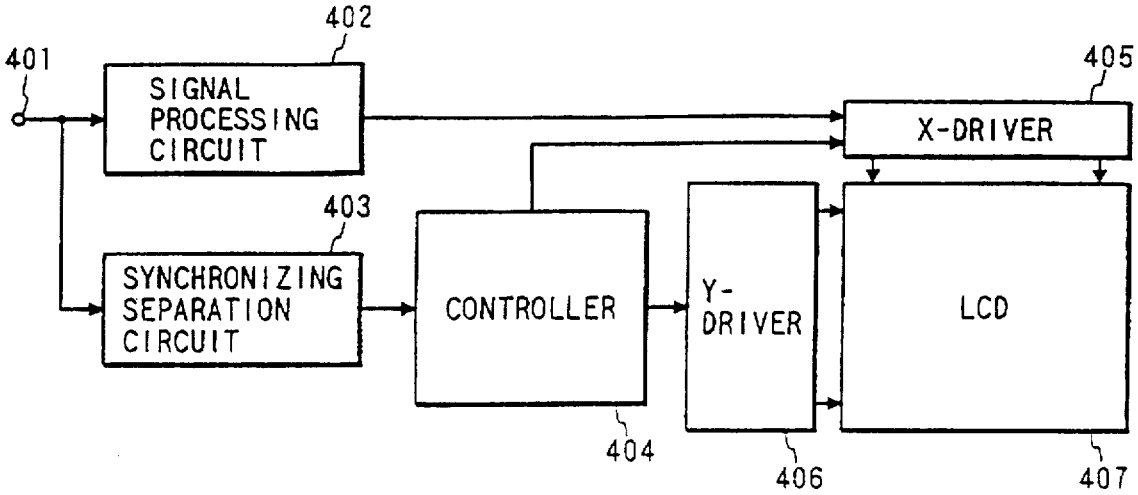
FIG. 30 PRIOR ART
FIG. 30 is a block diagram illustrating a conventional display device.
Figure 32:
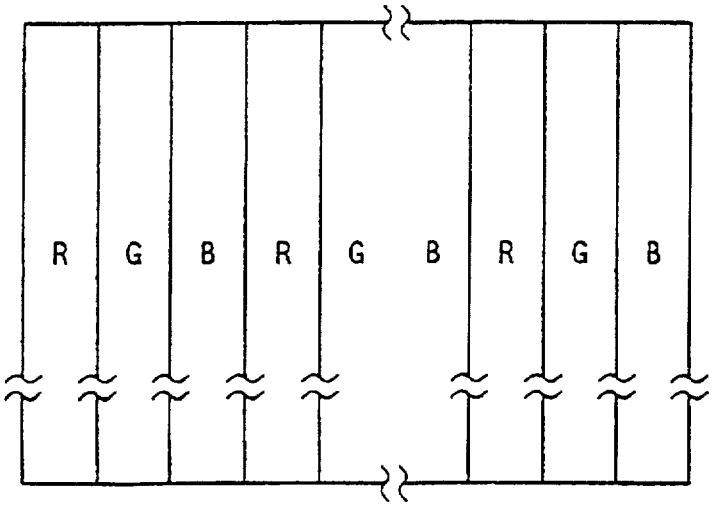
FIG. 32 PRIOR ART
FIG. 32 is a plan view of the arrangement of color pixels that is used for a display element.

Although, in this embodiment, the changes in the signal levels of a luminance signal and a color signal are detected, as is shown in FIG. 28, frequency elements of a luminance signal and of a color signal may be detected. More specifically, a luminance signal frequency detection circuit 514c detects frequency elements of a luminance signal that is produced by the luminance signal producing circuit 512. Similarly, a color signal frequency detection circuit 515c detects frequency elements of a color signal that is produced by the color signal producing circuit 513. The results of these detections are supplied to a discrimination circuit 516c. When the frequency of the luminance signal that is sent from the luminance signal frequency detection circuit 514c is greater than a predetermined value, and when the frequency of the color signal that is sent from the color signal frequency detection circuit 515c is smaller than a predetermined value, the discrimination circuit 516c determines that the target portion is a region in which characters are to be displayed, and outputs a corresponding mode select signal to the output terminal 517. In the other case, the discrimination circuit 516c determines that a target portion is a region in which characters are not displayed, and outputs a corresponding mode select switch to the output terminal 517. As is described above, the discrimination circuit in this embodiment ascertains that a portion of a display image, for which the frequency of a luminance signal is greater than a predetermined value and the frequency of a color signal is smaller than a predetermined value, is a region in which characters are displayed, and that the other region is a region in which characters are not displayed. According to the result of the determination, the discrimination circuit 416 outputs a select signal for controlling a phase for sampling before an image is to be displayed.

With this arrangement, for a region, of a liquid crystal display device that displays an input image in which character information is included, in which characters are not displayed, sampling of image signals relative to R, G and B pixels is performed at different phases, and for a region in which characters are displayed, sampling is performed for R, G and B pixels at the same phase. As a result, the resolution in a region in which an image is displayed is increased, and an occurrence of folded distortion can be prevented when characters are to be displayed.

A combination of the discrimination circuits that are used in the thirteenth and fourteenth embodiments may select a display mode in consonance with the results of determinations from a plurality of discrimination circuits, i.e., the signal level change and the frequency change.

[Fifteenth Embodiment]

The arrangement of a liquid crystal display device according to a fifteenth embodiment of the present invention is the same as that shown in FIG. 24. In FIG. 24, reference number 411 denotes a delay circuit for an image signal. An X-driver 405 is the same as that shown in FIG. 33A. As the arrangement of a character region discrimination circuit 408 is the same as that in the thirteenth or fourteenth embodiment, an explanation for it will not be given. The delay circuit 411 is the same as that in FIG. 17. Reference numbers 441R, 441G and 441B denote input terminals for image signals; 442R and 442G, switching circuits; 443, a delay circuit; 444R and 444G, switching circuits; 445, an input terminal for a mode select signal; and 446R, 446G and 446B, output terminals for image signals.

The operation of a liquid crystal display device according to the fifteenth embodiment of the present invention will now be described while referring to FIGS. 24 and 17. The signal processing circuit 402 performs a predetermined process on an image signal that is input at the input terminal 401. The processed signal is transmitted to the synchronizing separation circuit 403, which separates a synchronization signal from the received signal. The separated synchronization signal is transmitted to the controller 404. In response to the signal, the controller 404 supplies, to the X-driver 405 and the Y-driver 406, a predetermined drive pulse, for driving the LCD 407, that is synchronized with an image signal. The image signal output by the signal processing circuit 402 is supplied across the delay circuit 411 to the X-driver 405. The LCD 407 is driven by an image signal and a drive pulse, which are supplied by the X-driver 405, and a drive pulse that is supplied by the Y-driver 406, and character information is displayed on the LCD 407 with an image at the same time.

In addition, the character region discrimination circuit 412 identifies a region in which characters are included and a region in which characters are not included, and supplies to the input terminal of the X-driver 405 a mode select signal. More specifically, the character region discrimination circuit 412 connects the switching circuits 442R, 442G, 444R and 444G across side a for a region in which characters are displayed on a screen, and connects the switching circuits 442R, 442G, 444R and 444G across side b for a region in which characters are not displayed. The delay circuit 443 provides a delay that is equivalent to one pixel of the LCD 407. Thus, when the switching circuits 442R, 442G, 444R and 444G are connected across side a, image signal G, which is output at the output terminal 446G, is delayed by one pixel relative to image signal B, which is output at the output terminal 446B, and signal R, which is output at the output terminal 446R, is delayed by two pixels relative to signal B. When the switching circuits 442R, 442G, 444R and 444G are connected across side b, signals that are input at the input terminals 441R, 441G and 441B are sent unchanged to the output terminals 446R, 446G and 446B.

In this embodiment, since the X-driver 405 shown in FIG. 33A is employed, in the LCD 407 sampling is performed for R, G and B pixels at the same phase. However, when an image signal passes through the delay circuit 411, a delay process is performed for the image signal in a region in which characters are not displayed, so that the same effect as is obtained by sampling R, G and B pixels at different phases is acquired. Further, since an image signal for a region in which characters are not displayed does not pass through the delay circuit 411 and thus a delay process is not performed for that signal, sampling is performed for R, G and B pixels at the same phase. The operation hereinafter is the same as that in the thirteenth embodiment, and no further explanation will be given.

As is described above, in a liquid crystal display device which adds character information to an input image for a display, a conventional X-driver is applied, and as in the thirteenth and fourteenth embodiments, for a region in which characters are not displayed, sampling is performed at different phases for image signals relative to R, G and B pixels. For a region in which characters are displayed, sampling is performed at the same phase for R, G and B pixels. As a result, the resolution in a region in which an image is displayed is increased, and an occurrence of folded distortion can be prevented when characters are to be displayed.

As a modification of this embodiment, the delay circuit 411 in FIG. 24 may have the arrangement shown in FIG. 18. Reference numbers 451R, 451G and 451B denote input terminals for image signals; 452, a sample-hold circuit; and 453R, 453G and 453B, output terminals for image signals. For a region in which characters are not displayed, the controller 404 transmits to the delay circuit 411 sample-hold pulses shown in FIG. 19A. The phase of each pulse is shifted by one pixel of the LCD. Thus, in the delay circuit shown in FIG. 17, image signal G, which is output at the output terminal 453G, is delayed by one pixel relative to signal B, which is output at the output terminal 453B, and signal R, which is output at the output terminal 453R, is delayed by two pixels. For a region in which characters are displayed, pulses shown in FIG. 19B are supplied. By making the sample-hold circuits 452 pass signals through, image signals that are input at the input terminals 451R, 451G and 451B are output unchanged to the output terminals 453R, 453G and 453B.

Since the delay circuit is designed with sample-hold circuits, this arrangement can easily cope with a change in the number of pixels in the LCD.

[Sixteenth Embodiment]

The arrangement for a liquid crystal display device according to a sixteenth embodiment of the present invention is the same as that shown in FIG. 16 for the fifteenth embodiment, except that the X-driver 405 in FIG. 34 and the delay circuit 411 in FIG. 20 are employed. The operation for the ninth embodiment is also the same as that for the eighth embodiment, except for the control of these components, and no explanation for it will be given. The same reference numbers as are used in FIG. 17 are also used in FIG. 20 to denote corresponding or identical components. For a region in which characters are displayed, switching circuits 442B, 442G, 444B and 444G are connected across side a in consonance with a control signal from a character region discrimination circuit 412. For a region in which characters are not displayed, these switching circuits are connected across side b. Since the X-driver 405 is designed as is shown in FIG. 34, an LCD 407 performs sampling for R, G and B pixels at different timings. Since a delay process is not performed for an image signal for a region in which characters are not displayed, sampling is performed for R, G and B pixels at different phases. Since an image signal for a region in which characters are displayed passes through the delay circuit 411 and thus a delay process is performed for that signal, the same effect as is obtained by sampling the three pixels at the same phase can be acquired.

In this manner, the effect obtained in the fifteenth embodiment can also be acquired in this embodiment.

As well as in the fifteenth embodiment, the delay circuit 411 shown in FIG. 21 may be employed, and sample-hold pulses shown in FIGS. 22A and 22B may be supplied. In addition, sample-hold pulses in FIG. 22A can be supplied for a region in which characters are not displayed, and pulses in FIG. 22B can be supplied for a region in which characters are displayed.

As is described above, according to the present invention, in a liquid crystal display device which adds character information to an input image for a display, for a region in which characters are not displayed, sampling is performed at different phases for image signals relative to R, G and B pixels. For a region in which characters are displayed, sampling is performed at the same phase for R, G and B pixels. As a result, the resolution in a region in which an image is displayed is increased, and an occurrence of folded distortion can be prevented when characters are to be displayed.

Further, in a liquid crystal display device which adds character information to an input image for a display, a conventional X-driver can be applied without any modification.

What is claimed is:

1. A display device, which displays red, green and blue pixels in consonance with signal values that are acquired by sampling red, green and blue signals that are included in an input image signal during a predetermined cycle, comprising:

detection means for detecting a change value $|A-B|$ between continuous signal values A and B that are acquired by sampling;

first comparison means for comparing said signal value A with predetermined value L0;

second comparison means for comparing said change value $|A-B|$ with predetermined value D0; and replacement means for, in consonance with results of comparisons by said first and second comparison means, replacing a signal value, which is to be provided for a pixel for a specific color, with a signal value for another color.

2. A display device according to claim 1, wherein, when a result of a comparison by said first comparison means is $A<L0$, and a result of a comparison by said second comparison means is $|A-B|>D0$, said replacement means performs replacement of a signal value.

3. A display device which displays red, green and blue pixels in consonance with signal values that are acquired by sampling red, green and blue signals that are included in an input image signal during a predetermined cycle, comprising:

detection means for detecting a change value $|A-B|$ between two signal values A and B that are acquired by sampling;

means for comparing a predetermined comparison value in consonance with said signal value A;

comparison means for comparing said change value $|A-B|$ with said comparison value; and means for, in consonance with results of comparisons by said comparison means, replacing a signal value, which is to be provided for a pixel for a specific color, with a signal value for another color.

4. A display device which acquires red, green and blue signal values by sampling, during a predetermined cycle, for red, green and blue signals that are included in an input image signal, and which sequentially allocates said signal values for pixels of corresponding colors at each timing that is consonance with said cycle, comprising:

detection means for, in consonance with sequential signal values and a change value for at least one color that are acquired by sampling, determining that color moiré is noticeable; and means, when it is determined that said color moiré is noticeable, for allocating a signal value for a specific color to a pixel for a different color, instead of a signal value for said pixel for said different color.

5. A display device which performs sampling of an input image signal during a predetermined cycle and supplies the sampled signals to pixels for three colors, red, green and blue that are arranged in a matrix form, comprising:

sampling means for sequentially performing sampling of signals for red, green and blue display pixels in said input image signal as time elapses, and for respectively acquiring first through third red signal values rn1, rn2 and rn3, first through third green values gn1, gn2 and gn3 and first through third blue values bn1, bn2 and bn3; and selection means for selecting three signal values from among said thus acquired signal values and for comparing a difference between two signal values, which are selected from among said signal values obtained by sampling, with a predetermined value, and selecting and outputting three signal values in consonance with a result of said comparison.

6. A display device according to claim 5, wherein, when said selection means compares a difference |rn1−rn2| between said first and second red signal values rn1 and rn2 with threshold value Th, and as a result |rn1−rn2|>Th is established, or when said selection means compares a difference |rn2−rn3| between said second and third red signal values rn2 and rn3 with said threshold value Th, and as a result |rn2−rn3|>Th is established, said selection means selectively switches a signal value.

7. A display device according to claim 6, wherein, in consonance with the result of a comparison, said selection means changes said first red signal rn1 and said third-blue signal value bn3 to said signal value gn1, gn2 or gn3.

8. A display device according to claim 5, wherein, when said selection means compares a difference |gn1−gn2| between said first and second green signal values gn1 and gn2 with said threshold value Th, and as a result |gn1−gn2|>Th is established, or when said selection means compares a difference |gn2−gn3| between said second and third green signal values gn2 and gn3 with said threshold value Th, and as a result |gn2−gn3|>Th is established, said selection means selectively switches a signal value.

9. A display device according to claim 5, wherein, when said selection means compares a difference |bn1−bn2| between said first and second blue signal values bn1 and bn2 with said threshold value Th, and as a result |bn1−bn2|>Th is established, or when said selection means compares a difference |bn2−bn3| between said second and third blue signal values bn2 and bn3 with said threshold value Th, and as a result |bn2−bn3|>Th is established, said selection means selectively switches a signal value.

10. A display device according to claim 5, wherein, when said selection means compares a difference |rn1−gn2 | between said first red signal value rn1 and said second green signal value gn2 with said threshold value Th, and as a result |rn1−gn2|>Th is established, or when said selection means compares a difference |gn2−bn3| between said second green signal value gn2 and said third blue signal value bn3 with said threshold value Th, and as a result |gn2−bn3|>Th is established, said selection means selectively switches a signal value.

11. A display device according to any one of claims 5 to 7, wherein said sampling means performs sampling for red, green and blue control signals at said times t1, t2 and t3 in order for the individual colors, and as a result, acquires further signal values Frn1, Frn2 and Frn3, Fgn1, Fgn2 and Fgn3, and Fbn1, Fbn2 and Fbn3, in consonance with the result of comparison, said selection means selects Frn1, Fgn2 and Fbn3 from among said signal values.

12. A display device which performs sampling of image signals for colors different from each other and which applies the sampled signals to pixels of colors different from each other arranged in an adjacent relation, comprising:

a first circuit for supplying a mode switching signal for switching a sampling mode; and a second circuit for changing a sampling timing according to the mode switching signal, wherein when a character is to be displayed, the image signals for colors different from each other inputted in time series are sampled simultaneously and supplied to the pixels for colors different from each other arranged in the adjacent relation, and when non-character contents are to be displayed, the image signals for colors different from each other inputted in time series are sampled in sequence and supplied to the pixels for colors different from each other arranged in adjacent relation.

13. A display device according to claim 12, wherein said input image signals are a luminance signal and red, green and blue signals.

14. A display device according to claim 12, wherein said input image signals are red, green and blue signals.

15. A display device according to claim 12, further comprising a display element is a liquid crystal element.

16. A display device according to claim 15, wherein said display element has a diagonal measurement of 10 cm or smaller in screen size.

17. A display device according to claim 12, further comprising a detection circuit for determining that said input image signals include character information.

18. A display device according to claim 12, further comprising means for synthesizing character information and non-character information.

19. A display device according to claim 12, further comprising a detection circuit that detects a change of a luminance signal or of at least one color signal.

20. A display device according to claim 12, further comprising signal level detection means for detecting signal levels of a luminance signal and a color signal.

21. A display device according to claim 12, further comprising signal level change detection means for detecting a degree of a change of signal levels of a luminance signal and a color signal.

22. A display device according to claim 12, further comprising frequency detection means for detecting frequency elements of a luminance signal and a color signal.

23. A display device according to claim 12, further comprising:

a character generation circuit for generating character information to be displayed; and a synthesizing circuit for synthesizing the character information and the image signal.

24. A display device according to claim 12, wherein said second circuit is a switch provided m-stage flip flop and an output terminal.

25. A display device according to claim 12, wherein said first circuit for supplying the mode switching signal is a discrimination circuit for discriminating the character information and the non-character information from the image signal inputted.

26. A display device which performs sampling of image signals for colors different from each other, and which supplies the sampling signal to pixels for colors different from each other arranged in an adjacent relation comprising:

a first circuit for supplying a mode switching signal for switching a sampling mode;

a second circuit for changing a sampling timing according to the mode switching signal; and a delay circuit, wherein when non-character contents are to be displayed, one of the image signals for colors different from each other inputted in time series is relatively delayed, and the image signals are sampled simultaneously and supplied to the pixels for colors different from each other arranged in the adjacent relation, and when a character is to be displayed, the image signals for colors different from each other inputted in the time series are sampled simultaneously without relative delaying and are supplied to the pixels for colors different from each other arranged in the adjacent relation.

27. A display device according to claim 26, wherein said circuit for delaying the image signal is a sample hold circuit.

28. A display device according to claim 26, wherein said first circuit for supplying the mode switching signal is a discrimination circuit for discriminating the character information and the non-character information from the image signal inputted.

29. A display device according to claim 26, wherein said input image signals are a luminance signal and red, green and blue signals.

30. A display device according to claim 26, wherein said input image signals are red, green and blue signals.

31. A display device according to claim 26, further comprising a display element having a liquid crystal element.

32. A display device according to claim 31, wherein said display element has a diagonal measurement of 10 cm or smaller in screen size.

33. A display device according to claim 26, further comprising a detection circuit for determining that said input image signals include character information.

34. A display device according to claim 26, further comprising means for synthesizing character information and non-character information.

35. A display device according to claim 26, further comprising a detection circuit that detects a change of a luminance signal or of at least one color signal.

36. A display device according to claim 26, further comprising signal level detection means for detecting signal levels of said luminance signal and said color signal.

37. A display device according to claim 26, further comprising signal level change detection means for detecting a degree of a change of signal levels of said luminance signal and said color signal.

38. A display device according to claim 26, further comprising frequency detection means for detecting frequency elements of said luminance signal and said color signal.

39. A display device which performs sampling of image signals for colors different from each other and which supplies the sampling signal to pixels for colors different from each other arranged in an adjacent relation comprising:

a first circuit for supplying a mode switching signal for switching a sampling mode;

a second circuit for changing a sampling timing according to the mode switching signal; and a delay circuit, wherein when a character is to be displayed, one of the image signals for colors different from each other inputted in time series is relatively delayed, and the image signals are sampled in sequence and supplied to the pixels for colors different from each other arranged in the adjacent relation, and when non-character contents are to be displayed, the image signals for colors different from each other inputted in the time series are sampled in sequence without relative delaying and are supplied to the pixels for colors different from each other arranged in the adjacent relation.

40. A display device according to claim 39, wherein said circuit for delaying the image signal is a sample hold circuit.

41. A display device according to claim 39, wherein said first circuit for supplying the mode switching signal is a discrimination circuit for discriminating the character information and the non-character information from the image signal inputted.

42. A display device according to claim 39, wherein said input image signals are a luminance signal and red, green and blue signals.

43. A display device according to claim 39, wherein said input image signals are red, green and blue signals.

44. A display device according to claim 39, further comprising a display element having a liquid crystal element.

45. A display device according to claim 44, wherein said display element has a diagonal measurement of 10 cm or smaller in screen size.

46. A display device according to claim 39, further comprising a detection circuit for determining that said input image signals include character information.

47. A display device according to claim 39, further comprising means for synthesizing character information and non-character information.

48. A display device according to claim 39, further comprising a detection circuit that detects a change of a luminance signal or of at least one color signal.

49. A display device according to claim 39, further comprising signal level detection means for detecting signal levels of said luminance signal and said color signal.

50. A display device according to any one of claims 20, 36 or 49, further comprising character region discrimination means for determining that a display image is a region in which character information is included when said signal level of said luminance signal that is detected by said signal level detection means is higher than a predetermined value, and when said signal level of said color signal is lower than a predetermined value.

51. A display device according to claim 39, further comprising signal level change detection means for detecting a degree of a change of signal levels of said luminance signal and said color signal.

52. A display device according to any one of claims 21, 37 or 51 further comprising character region discrimination means for determining that a display image is a region in which character information is included when said degree of a change of said signal level of said luminance signal that is detected by said signal level change detection means is higher than a predetermined value and when said degree of a change of said signal level of said color signal is lower than a predetermined value.

53. A display device according to claim 39, further comprising frequency detection means for detecting frequency elements of said luminance signal and said color signal.

54. A display device according to any one of claims 22, 38 or 53, further comprising character region discrimination means for determining that a display image is a region in which character information is included when said frequency of said luminance signal that is detected by said frequency detection means is higher than a predetermined value and when said frequency of said color signal is lower than a predetermined value.

55. A display device for sampling image signals for red, green and blue, and supplying the image signals to pixels for red, green and blue arranged in an adjacent relation, comprising:

first means for sampling simultaneously the image signals for red, green and blue;

second means for sampling a luminance signal;

means for selecting one from among the image signal for red sampled in a first timing and the image signal for green sampled in a second timing, and for selecting one from among the image signal for green sampled in the second timing and the image signal for blue sampled in a third timing; and comparing means for calculating a difference between the luminance signals sampled in the first, second and third timings, and comparing the difference with a predetermined threshold value, wherein a) when the difference of the luminance signals sampled in the first and second timings is smaller than a predetermined value, the image signal for red sampled in the first timing is supplied to the red pixel while, when the difference is larger than the predetermined value, the image signal for green sampled in the second timing is supplied to the red pixel, b) the image signal for green sampled in the second timing is supplied to the green pixel, and c) the difference between the luminance signals sampled in the second and third timings is smaller than the predetermined value, the image signal for blue sampled in the third timing is supplied to the blue pixel while, when the difference is larger than the predetermined value, the image signal for green sampled in the second timing is supplied to the blue pixel.

56. A display device for sampling image signals for red, green and blue, and supplying the image signals to pixels for red, green and blue arranged in an adjacent relation, comprising:

means for sampling simultaneously the image signals for red, green and blue;

means for selecting one from among the image signal for red sampled in a first timing and the image signal for green sampled in a second timing, and for selecting one from among the image signal for green sampled in the second timing and the image signal for blue sampled in a third timing; and comparing means for calculating a difference between the image signals for green sampled in the first, second and third timings, and comparing the difference with a predetermined threshold value, wherein a) when the difference of the image signals for green sampled in the first and second timings is smaller than a predetermined value, the image signal for red sampled in the first timing is supplied to the red pixel while, when the difference is larger than the predetermined value, the image signal for green sampled in the second timing is supplied to the red pixel, b) the image signal for green sampled in the second timing is supplied to the green pixel, and c) the difference between the image signals for green sampled in the second and third timings is smaller than the predetermined value, the image signal for blue sampled in the third timing is supplied to the blue pixel while, when the difference is larger than the predetermined value, the image signal for green sampled in the second timing is supplied to the blue pixel.

* * * * *

UNITED STATES PATENT AND TRADEMARK OFFICE

CERTIFICATE OF CORRECTION

PATENT NO. : 5,748,167

DATED : May 5, 1998

INVENTOR(S) : Watanabe et al.

It is certified that error appears in the above-identified patent and that said Letters Patent is hereby corrected as shown below:

In the drawings,

SHEET 19:

FIG. 24, "DELAYL" should read --DELAY--.

COLUMN 2:

Line 51, "moire," should read --moiré,--.

COLUMN 4:

Line 64, "utilize" should read --be utilized--.

COLUMN 14:

Line 51, "signal" should read --signals--.

COLUMN 24:

Line 55, "g2from" should read --g2 from--.

COLUMN 38:

Line 17, "device," should read --device--.
Line 61, "is" should read --is in--.
Line 63, "are" should read --is--.

UNITED STATES PATENT AND TRADEMARK OFFICE

CERTIFICATE OF CORRECTION

PATENT NO. : 5,748,167

DATED : May 5, 1998

INVENTOR(S) : Watanabe et al.

It is certified that error appears in the above-identified patent and that said Letters Patent is hereby corrected as shown below:

COLUMN 39:

Line 32, "third-blue" should read --third blue--.
Line 63, "7," should read --10,--.

COLUMN 40:

Line 27, "is" should read --having--.
Line 57, "provided" should read --provided with an--.

Signed and Sealed this

Thirteenth Day of July, 1999

*Attest:*

Q. TODD DICKINSON

*Attesting Officer*

*Acting Commissioner of Patents and Trademarks*